US006814019B2

(12) United States Patent
Mears et al.

(10) Patent No.: US 6,814,019 B2
(45) **Date of Patent: *Nov. 9, 2004**

(54) INFLATING WATERCRAFT FLOTATION DEVICE

(75) Inventors: Tony W. Mears, Longmont, CO (US); Nicolae Toderica, Longmont, CO (US); Valerica Grigore, Longmont, CO (US)

(73) Assignee: FloatLogic, Inc., Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/223,668

(22) Filed: Aug. 19, 2002

(65) Prior Publication Data

US 2003/0213420 A1 Nov. 20, 2003

Related U.S. Application Data

(63) Continuation-in-part of application No. 09/940,975, filed on Aug. 28, 2001, now Pat. No. 6,470,818, which is a continuation-in-part of application No. 09/864,642, filed on May 24, 2001, now Pat. No. 6,435,125, which is a continuation-in-part of application No. 09/832,774, filed on Apr. 10, 2001, now Pat. No. 6,484,656.

(51) Int. Cl.[7] ..... B63C 9/04

(52) U.S. Cl. ..... 114/68; 114/123

(58) Field of Search ..... 114/68, 69, 123, 114/219, 345, 348, 360; 441/38, 39, 40, 66

(56) References Cited

U.S. PATENT DOCUMENTS

| | | | | |
|---|---|---|---|---|
| 151,400 A | * | 5/1874 | Keeler et al. | |
| 980,790 A | * | 1/1911 | Johnson | |
| 1,038,928 A | * | 9/1912 | Menzel | |
| 1,133,629 A | | 3/1915 | Foster | 114/68 |
| 1,220,876 A | * | 3/1917 | Moore | |
| 1,249,633 A | * | 12/1917 | Jelercic | |
| 1,622,508 A | * | 3/1927 | Harper | |
| 2,508,304 A | * | 5/1950 | Sturtevant | 114/345 |
| 2,914,779 A | * | 12/1959 | Walker | 441/39 |
| 2,924,192 A | | 2/1960 | Salvage | 114/68 |
| 3,822,662 A | | 7/1974 | Morita et al. | 114/68 |
| 4,389,961 A | | 6/1983 | Parish | 114/345 |
| 4,458,618 A | * | 7/1984 | Tuffier | 114/68 |
| 4,495,880 A | * | 1/1985 | Maniscalco et al. | 114/123 |
| 4,517,914 A | * | 5/1985 | Geracitano | 114/345 |
| 4,545,319 A | * | 10/1985 | Ferronniere et al. | 114/345 |
| 4,667,618 A | * | 5/1987 | Cigognetti | 114/345 |
| 4,678,443 A | * | 7/1987 | Edwards et al. | 441/38 |
| 4,723,929 A | * | 2/1988 | Parish | 441/39 |
| 4,817,555 A | * | 4/1989 | Meinen | 114/360 |
| 4,864,961 A | * | 9/1989 | Slonski | 114/360 |
| 4,867,094 A | * | 9/1989 | Binks | 114/359 |
| 4,996,936 A | * | 3/1991 | Brundritt | 114/68 |
| 5,215,031 A | * | 6/1993 | Inman et al. | 114/360 |
| 5,357,888 A | * | 10/1994 | Insinna | 114/69 |

FOREIGN PATENT DOCUMENTS

DE 3530618 A1 * 3/1987

* cited by examiner

*Primary Examiner*—S. Joseph Morano
*Assistant Examiner*—Lars A. Olson
(74) *Attorney, Agent, or Firm*—Emery L. Tracy

(57) ABSTRACT

A flotation device for maintaining a watercraft in a floating condition is provided. The flotation device comprising a cover releasably secured to the watercraft. At least one directing bladder is positioned between the cover and the watercraft. At least one inflatable flotation bladder is positioned between the cover and the watercraft wherein upon inflation of the directing bladder, the directing bladder releases at least a portion of the cover from the watercraft.

19 Claims, 26 Drawing Sheets

FIG. 24
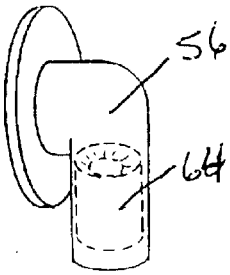
Check Valve
FIG. 25
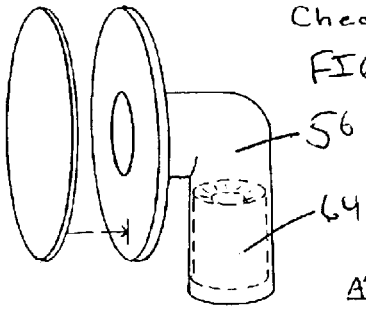
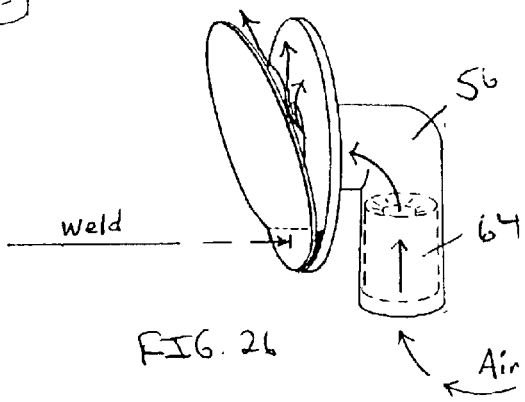
FIG. 26
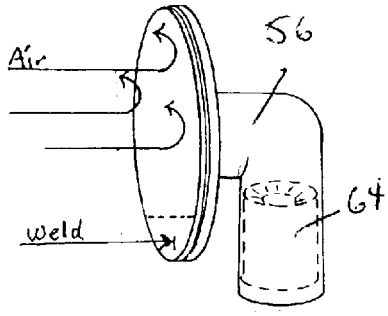
FIG. 27

FIG. 30
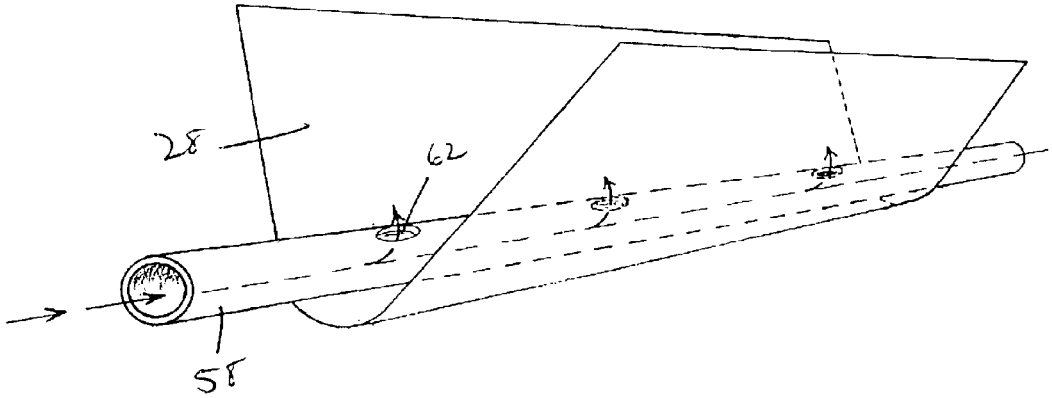
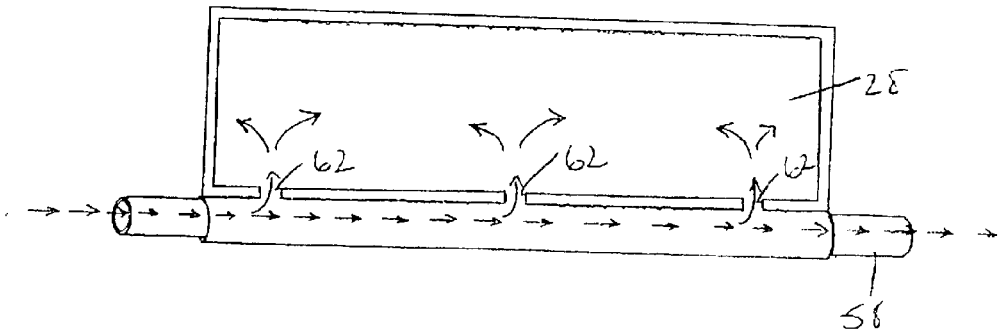
FIG. 31

64
10
22

INFLATING WATERCRAFT FLOTATION DEVICE

The present application is a continuation-in-part of patent application Ser. No. 09/832,774, filed Apr. 10, 2001 now U.S. Pat. No. 6,484,656, entitled "Automatic Boat Flotation Device", patent application Ser. No. 09/864,642, filed May 24, 2001 now U.S. Pat. No. 6,435,125, entitled "Float Switch Activation Assembly", and patent application Ser. No. 09/940,975, filed Aug. 28, 2001 now U.S. Pat. No. 6,470,818, entitled "Automatic Boat Flotation Device".

BACKGROUND OF THE INVENTION

1. Field of the Invention

The present invention relates to flotation devices for watercraft and, more particularly, it relates to an automatically inflating flotation device that would improve the stability of the watercraft and inhibit the watercraft from sinking if the hull was breached. The flotation device is inflatable, either manually or automatically, when a predetermined amount of water entered the hull of the watercraft thereby increasing stability and inhibits sinking.

2. Description of the Prior Art

Boating is both a popular pastime and a vital commercial activity in much of the world today. A boat is often a substantial investment for the owner and/or operator. In the case of commercial boats, the boat is often the livelihood of the owner of the boat. As a general concept, boats sink when the hull of the boat takes on water and the boat loses its buoyancy. This can happen if the hull is breached due to a collision with some object or in heavy waves if the boat is swamped. If the boat sinks, a serious condition exists in that loss of life and loss of property often occurs.

A number of patents have been directed to inventions to prevent a boat from sinking, even if the hull was breached. Unfortunately, the previous devices for boat floatation have a number of problems such as being difficult to install and often require manual activation of the device. This is a major concern since many boats often sink unattended at the dock, not out on the open water.

The flotation device of the present invention solves these problems and others by being easy to install, either as a retrofit to an existing boat or during manufacture of the boat. In addition, the flotation device of the present invention is designed to automatically deploy when a predetermined level of water is consistently in the hull of the vessel. The device will not deploy when water merely splashes to that level, preventing unneeded deployment in heavy seas. Once deployed the present invention will keep the boat afloat even if a complete flooding of the hull has occurred.

The primary aspect of the present invention is to provide a deployable flotation device to keep the boat floating after water has partially filled the hull of the boat.

Another aspect of the present invention is to provide a flotation device that does not interfere with the looks or operation of the boat when not deployed.

Another aspect of the present invention is to provide for a flotation device that can be easily removed and a new one re-installed after deployment.

Another aspect of the present invention is to provide a device that is easy to manufacture and install.

SUMMARY

In particular, the present invention is a flotation device for maintaining a watercraft in a floating condition. The flotation device comprises a cover releasably secured to the watercraft. At least one directing bladder is positioned between the cover and the watercraft. At least one inflatable flotation bladder is positioned between the cover and the watercraft wherein upon inflation of the directing bladder, the directing bladder releases at least a portion of the cover from the watercraft.

The present invention further includes a method for maintaining a watercraft in a floating condition. The method comprises releasably securing a cover to the watercraft, positioning at least one directing bladder between the cover and the watercraft, positioning at least one inflatable flotation bladder between the cover and the watercraft, inflating the directing bladder, and inflating the flotation bladder.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 24 is a perspective view illustrating the positioned orifice within the valve;

FIGS. 25–27 are perspective views illustrating the valve functioning as a check valve to control the direction of airflow to the flotation bladders;

FIG. 30 is a perspective view illustrating an alternative embodiment of mounting the flotation bladders and directing bladders to the gas supply lines;

FIGS. 31–32 are elevational side views illustrating the embodiment of FIG. 30 of mounting the flotation bladders and directing bladders to the gas supply lines;

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENTS

As discussed above, the present application is a continuation-in-part of pending patent application Ser. No. 09/832,774, filed Apr. 10, 2001, entitled "Automatic Boat Flotation Device", pending patent application Ser. No. 09/864,642, filed May 24, 2001, entitled "Float Switch Activation Assembly", and pending patent application Ser. No. 09/940,975, filed Aug. 28, 2001, entitled "Automatic Boat Flotation Device", assigned to the same assignee of the present invention. These patent applications are hereby herein incorporated by reference.

Figure 1:
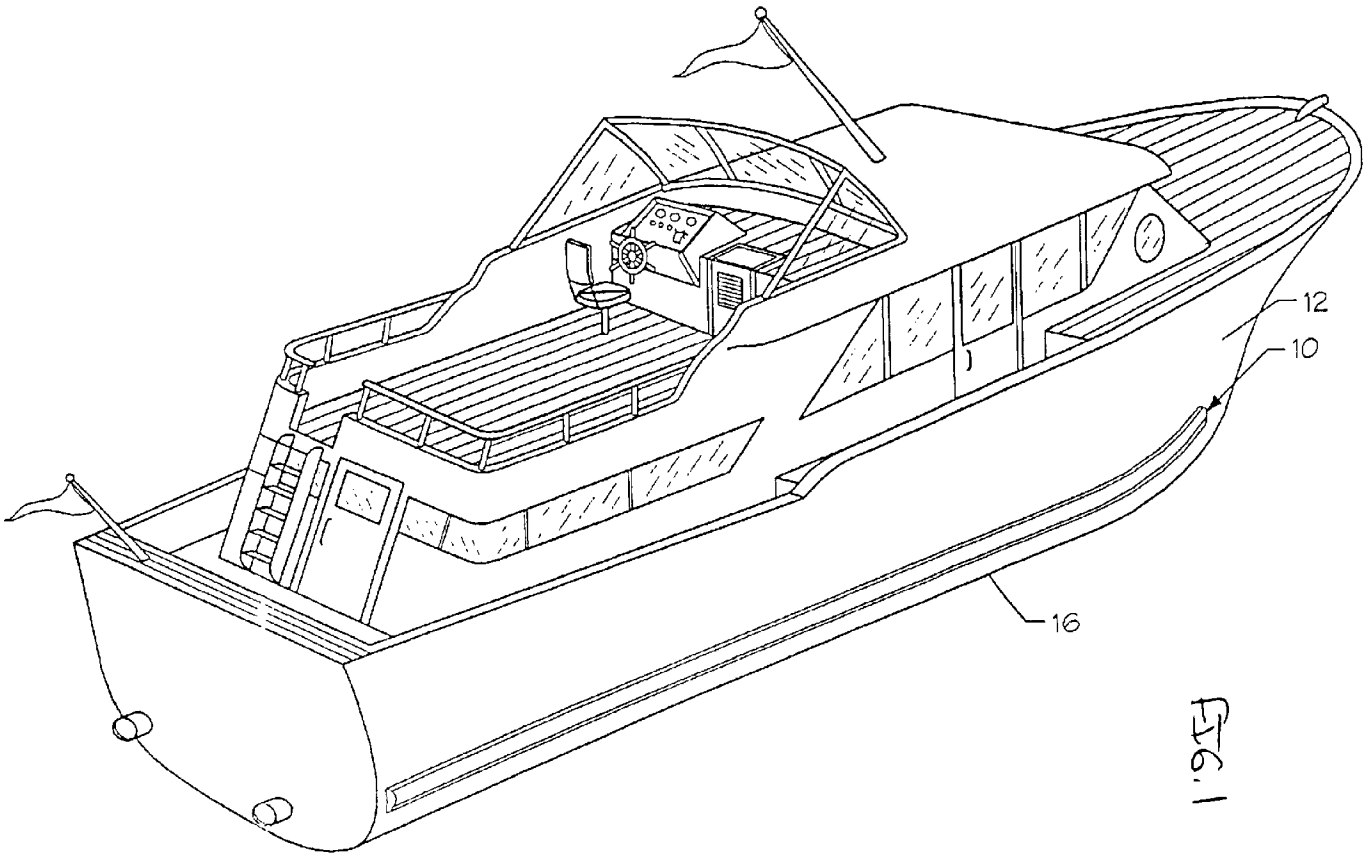
FIG. 1 is a perspective view illustrating a flotation device for inflation by a float switch activation assembly, constructed in accordance with the present invention, with the flotation device being mounted on a hull of a watercraft.

As illustrated in FIG. 1, the present invention is a flotation device, indicated generally at 10, mounted to a watercraft 12 and which activates, either manually or automatically, to maintain the watercraft 12 in a floating condition during the occurrence of a predetermined event such as water entering the watercraft 12. The watercraft 12 can be any type of watercraft including, but not limited to, pleasure boats, commercial ships, military ships, cruise ships, power boats, row boats, canoes, life boats, rafts, pontoon boats, ski boats, jet skis, etc.

The flotation device 10 is preferably mounted on the exterior of the hull 16 of the watercraft 12. Preferably, the flotation device 10 has a low profile and an unobtrusive visual presence, so that the flotation device 10 does not significantly affect either the aerodynamic or visual lines of the watercraft 12 when not inflated, as described in further detail below.

Figure 2:
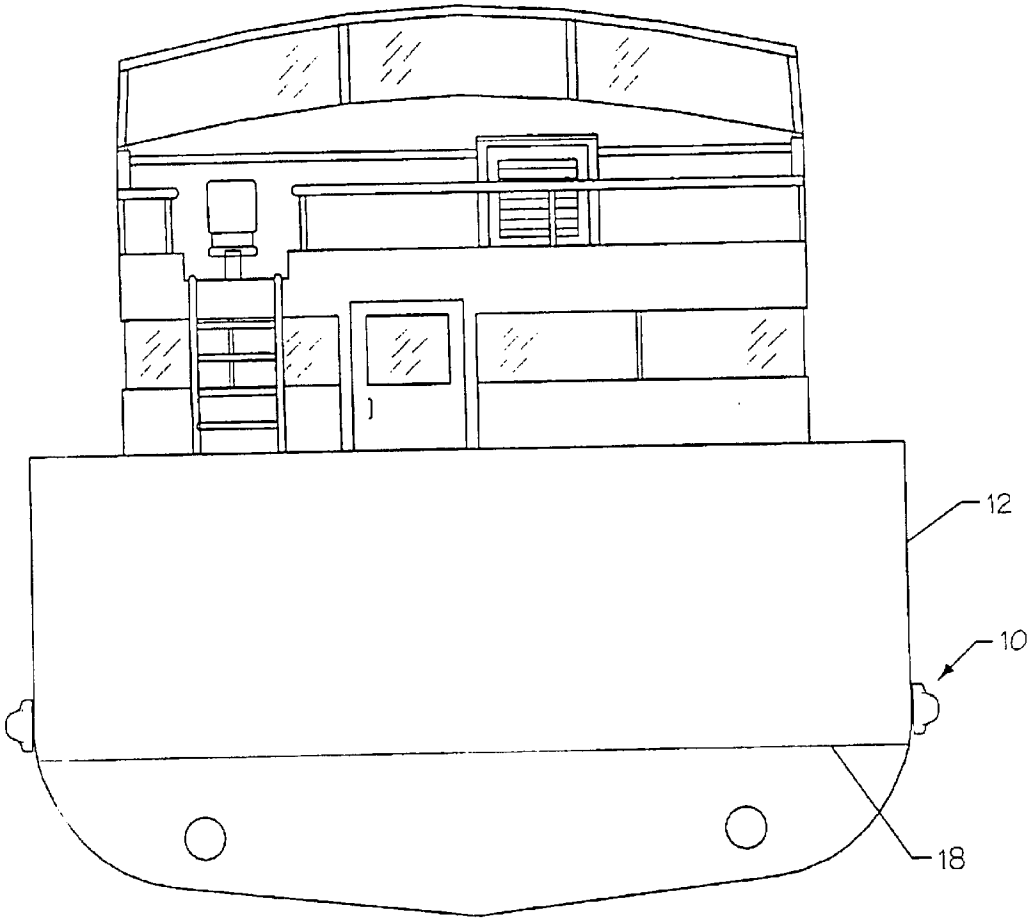
FIG. 2 is a rear view illustrating the flotation device, constructed in accordance with the present invention, with the flotation device mounted to the hull adjacent the waterline.
Figure 3:
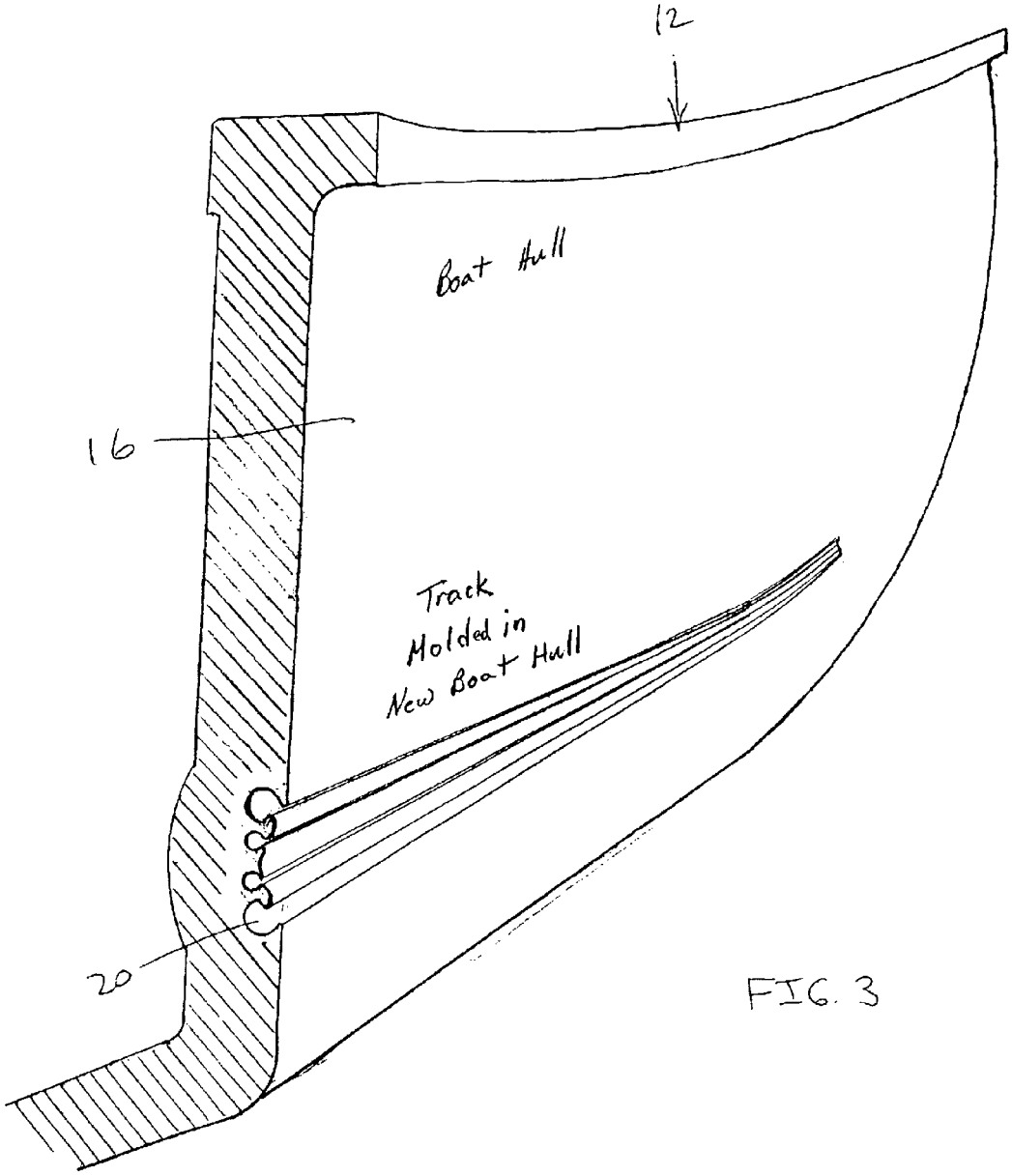
FIG. 3 is a perspective view illustrating hull of the watercraft molded to directly receive the flotation device.
Figure 4:
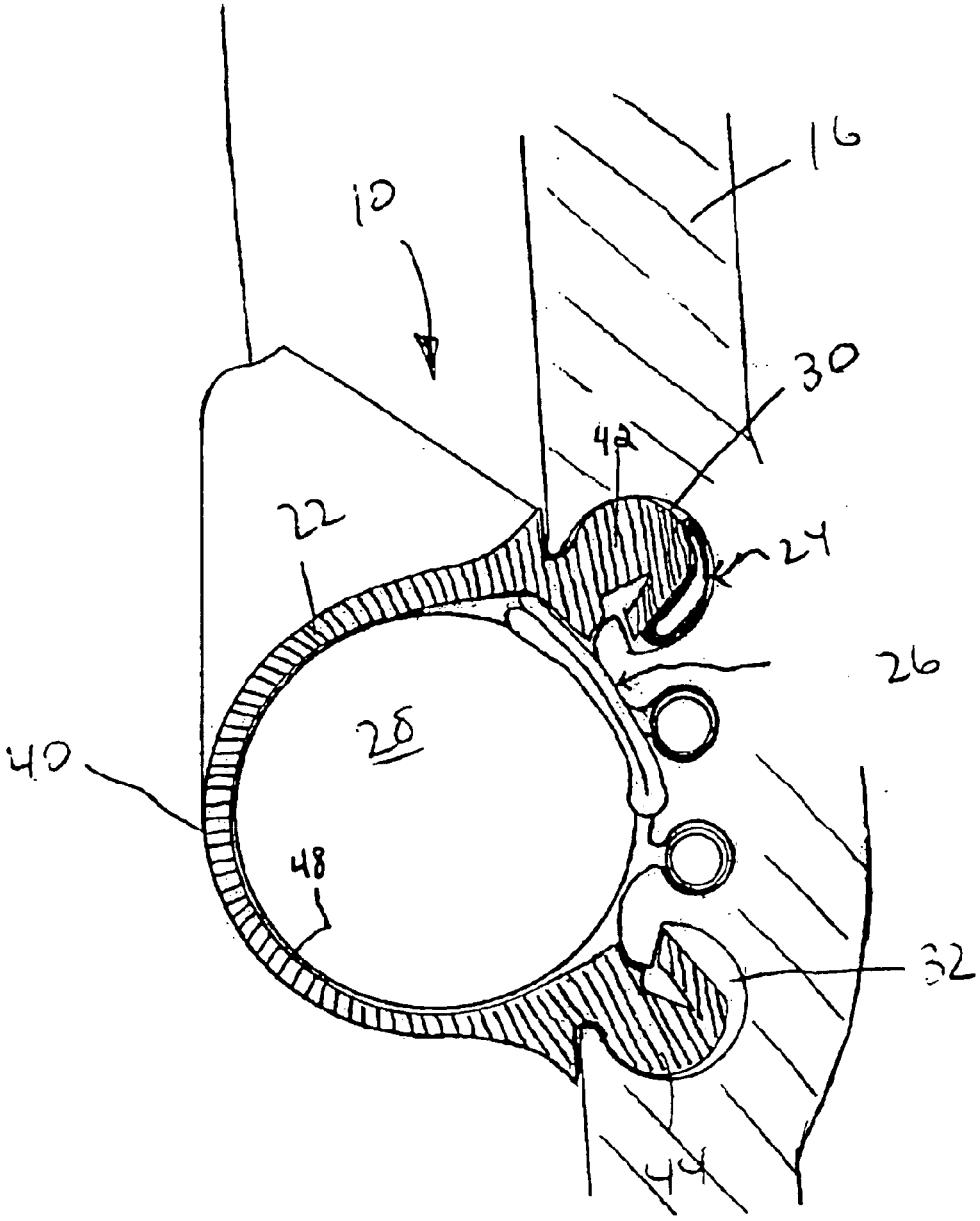
FIG. 4 is a sectional view illustrating the flotation device, constructed in accordance with the present invention, mounted within the hull of FIG. 3.

As illustrated in FIG. 2, the flotation device 10 is mounted at approximately the water line 18 on the hull 16 of the watercraft 12. As illustrated in FIGS. 3 and 4, the hull 16 of the watercraft 12 can be molded to receive the flotation device 10 of the present invention. In this embodiment, the flotation device 10 is receivable within the molded hull 16 without the need for a mounting plate (as will be described as further below).

Figure 5:
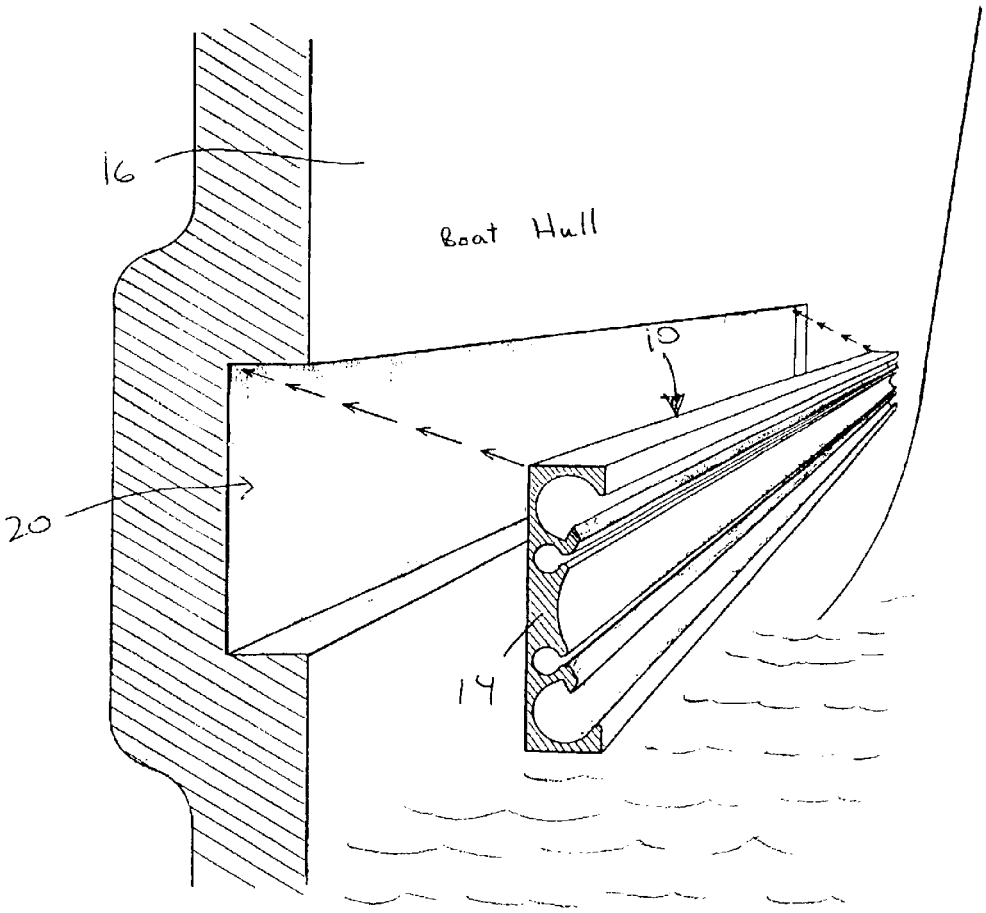
FIG. 5 is perspective view illustrating the hull of the watercraft molded with a longitudinal recess and the mounting plate receivable within the longitudinal recess.
Figure 6:
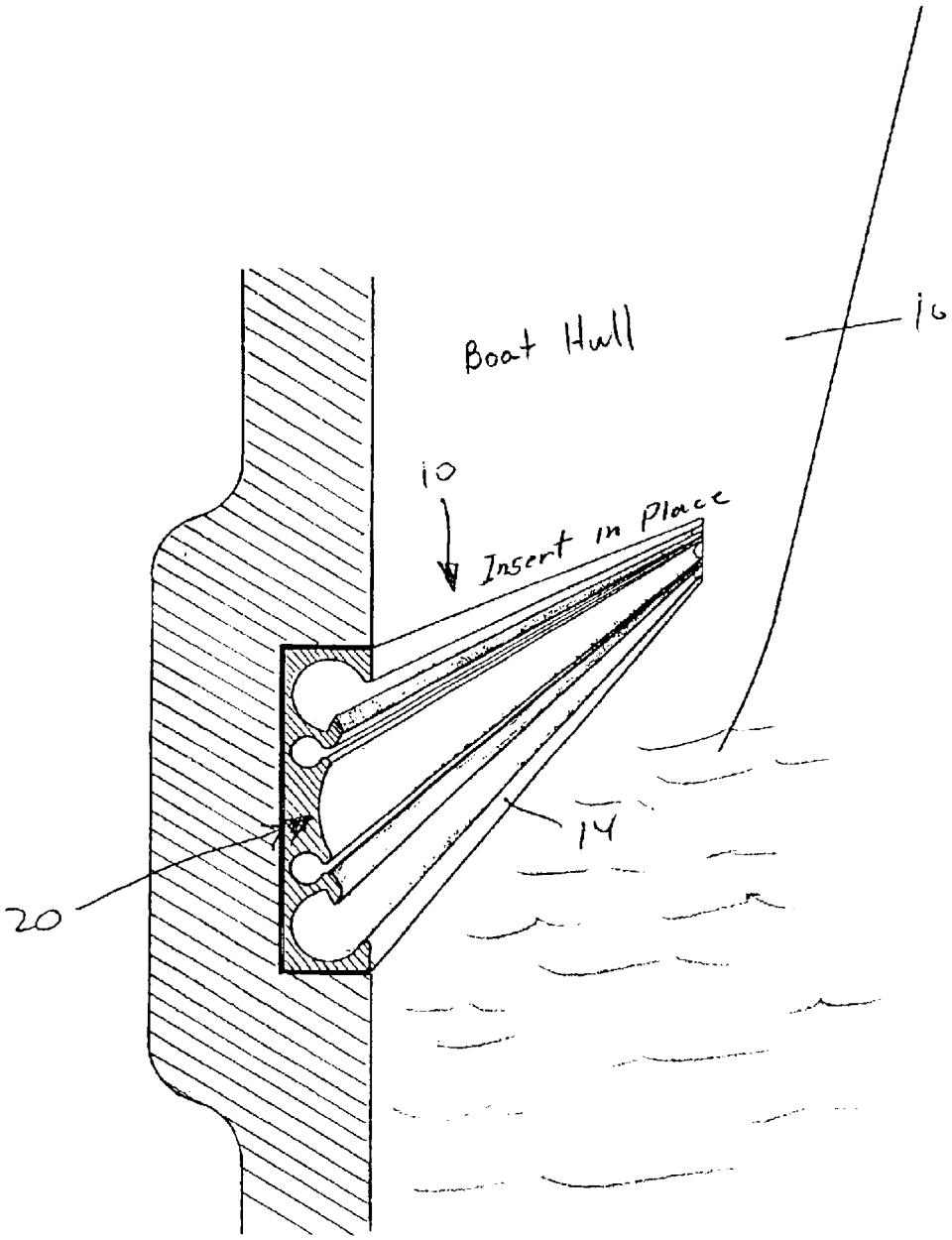
FIG. 6 is a perspective view illustrating the hull of the watercraft of FIG. 5 with the mounting plate secured within the longitudinal recess.

In another embodiment of the flotation device 10 of the present invention, as illustrated in FIGS. 5 and 6, the hull 16 can have a longitudinal recess 20 molded therein and a mounting plate 14 can be co-molded as an extrusion. In this embodiment, the mounting plate 14 is be inserted and secured within the longitudinal recess 20 of the hull 16 after the watercraft 12 is constructed. Securement of the mounting plate 14 within the longitudinal recess 20 of the hull 16 can be accomplished by any means including, but not limited to, adhesive, screws, rivets, bolts, etc. The mounting of the mounting plate 14 within the longitudinal recess 20 reduces the outward extent of the flotation device 10 from the outside of the watercraft 12. In fact, depending on the depth of the recess 20, the extent of the flotation device 10 can be even with or below the exterior hull 16 of the watercraft 12.

The mounting plate 14 of each embodiment is preferably constructed from a semi-rigid material, such as UHMW plastic. The mounting plate 14 is preferably constructed from plastic, resin, metal, such as aluminum, or similar material although constructing the mounting plate 14 from different types of material is within the scope of the present invention. The material must be flexible enough to allow the mounting plate 14 to bend to match the curve of the watercraft hull 16 and to allow compression and bending under pressure. However, the material of the mounting plate 14 must to be rigid enough so that the inflation of the flotation bladder 28 will not dislodge the flotation bladder 28 from the mounting plate 14.

Preferably, the mounting plate 14 is mounted to the exterior of the watercraft hull 16 or within the recess 20 using either an adhesive for fiberglass and for metal hulls or screws for wood hulls (not shown). The preferred type of adhesive is a two-part epoxy. The preferred brand of epoxy is DP 190 or 460, manufactured by Minnesota Mining and Manufacturing (3M), St. Paul, Minn. Screws (not shown) may be necessary on wooden hulled boats since some adhesive only sticks to the outermost layer of paint on the exterior of the hull 16.

Figure 14:
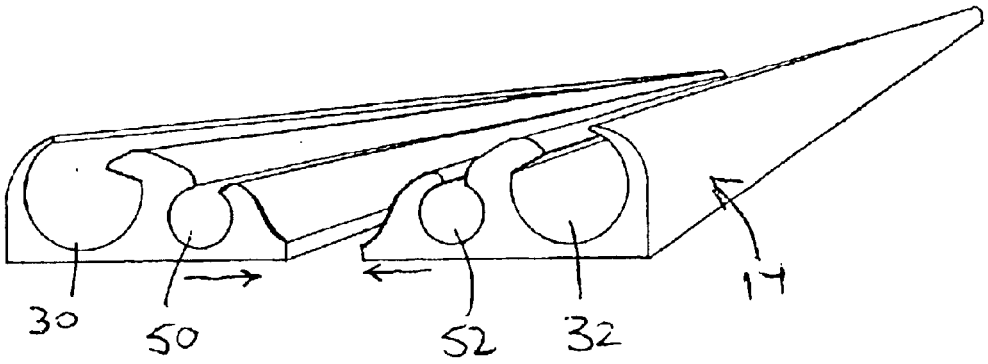
FIG. 14 is a perspective view illustrating the mounting plate of the flotation device, the mounting plate split into two sections to accommodate various sized flotation bladders.

As illustrated in FIGS. 7–13, the flotation device 10 of the present invention further includes a cover 22, a cover-removing tubing 24, a directing bladder 26, and a main flotation bladder 28. As illustrated in FIG. 14, the mounting plate 14 has two channels 30, 32 spaced apart from each other and extending longitudinally along the length of the mounting plate 14. The mounting plate 14 can be extruded or otherwise constructed in a single piece or can be constructed in two separate pieces to allow accommodation of various-sized flotation bladders 24. The two separate pieces of the mounting plate 14 can be moved apart or together during mounting of the mounting plate 14 to accommodate the various flotation bladder 28 sizes.

The flexible cover-removing tubing 24 is positioned in at least one of the channels 30, 32 of the mounting plate 14. The cover-removing tubing 24 is constructed from a flexible material so that the cover-removing tubing 24 can be collapsed against itself. When the cover-removing tubing 24 is expanded it substantially fills the channels 30 and/or 32, as illustrated in FIGS. 8–11. Operation of the cover-removing tubing 24 and the process of inflating the remainder of the flotation device 10 will be described in further detail below.

Figure 7:
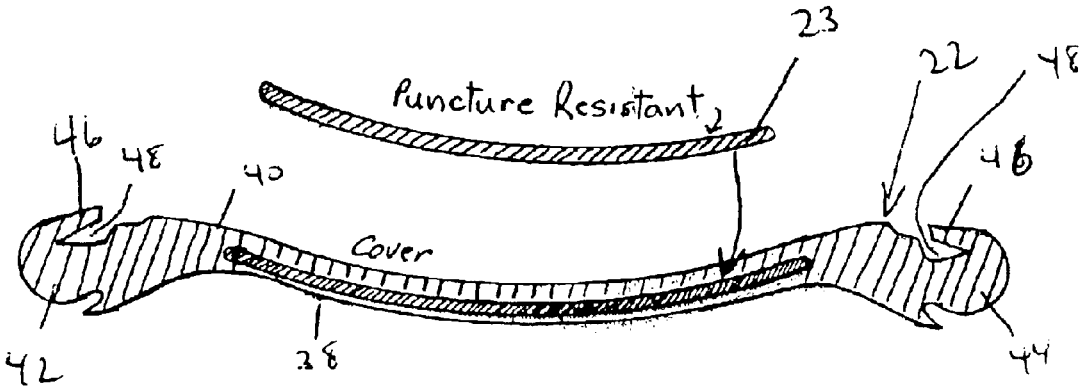
FIG. 7 is a sectional view illustrating the cover of the flotation device, constructed in accordance with the present invention.
Figure 8:
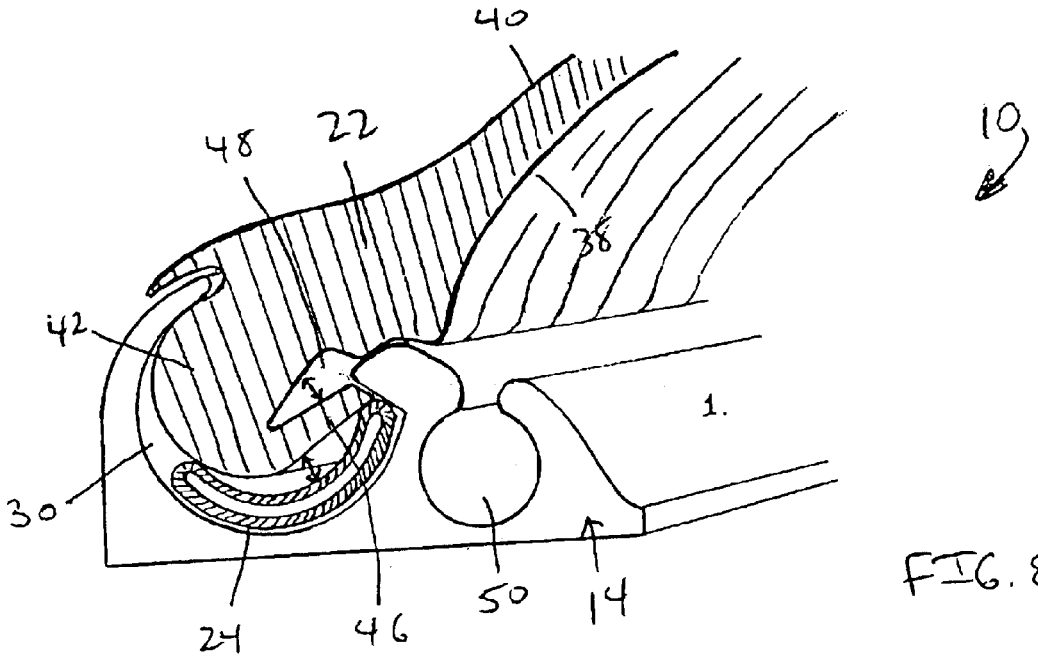
FIG. 8 is a sectional view illustrating the flotation device with a cover-removing tubing in the non-inflated condition.
Figure 9:
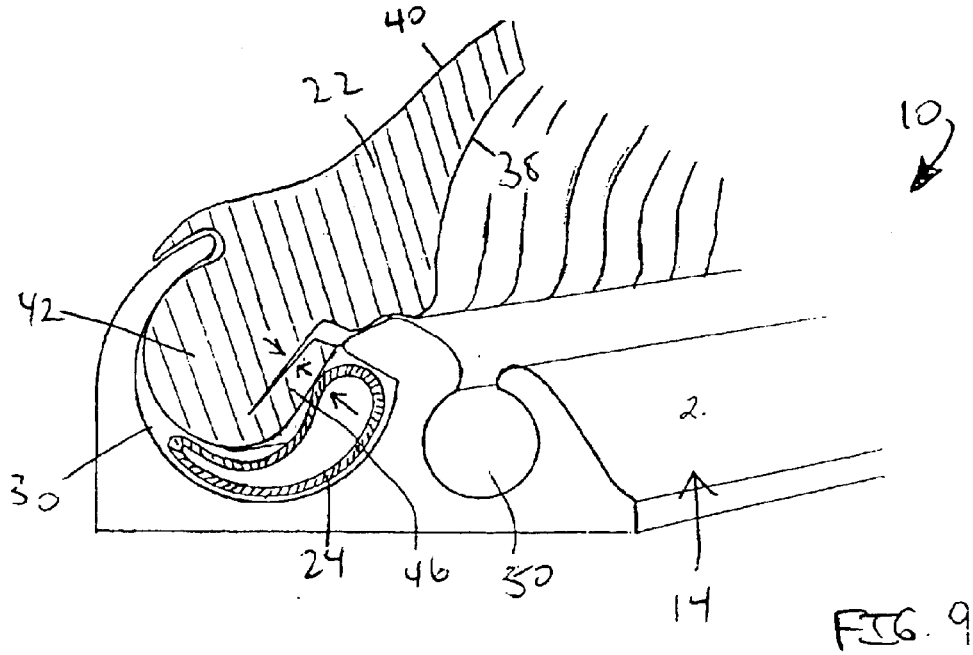
FIG. 9 is a sectional view illustrating the flotation device beginning the inflation process of the cover-removing tubing from the non-inflated condition.
Figure 10:
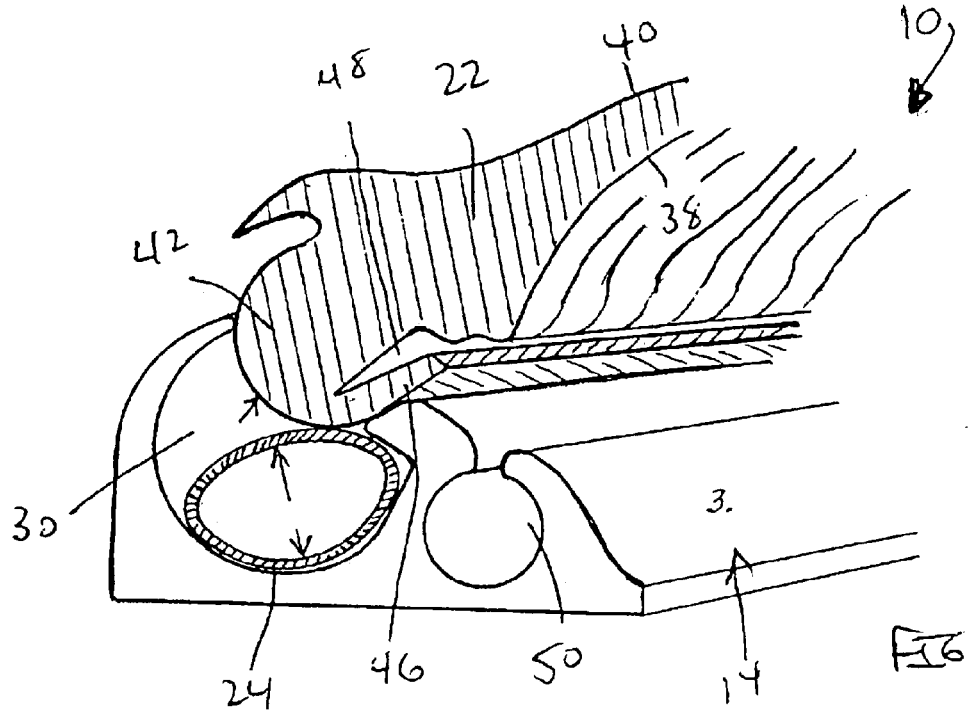
FIG. 10 is a sectional view illustrating the flotation device continuing the inflation process of the cover-removing tubing.
Figure 11:
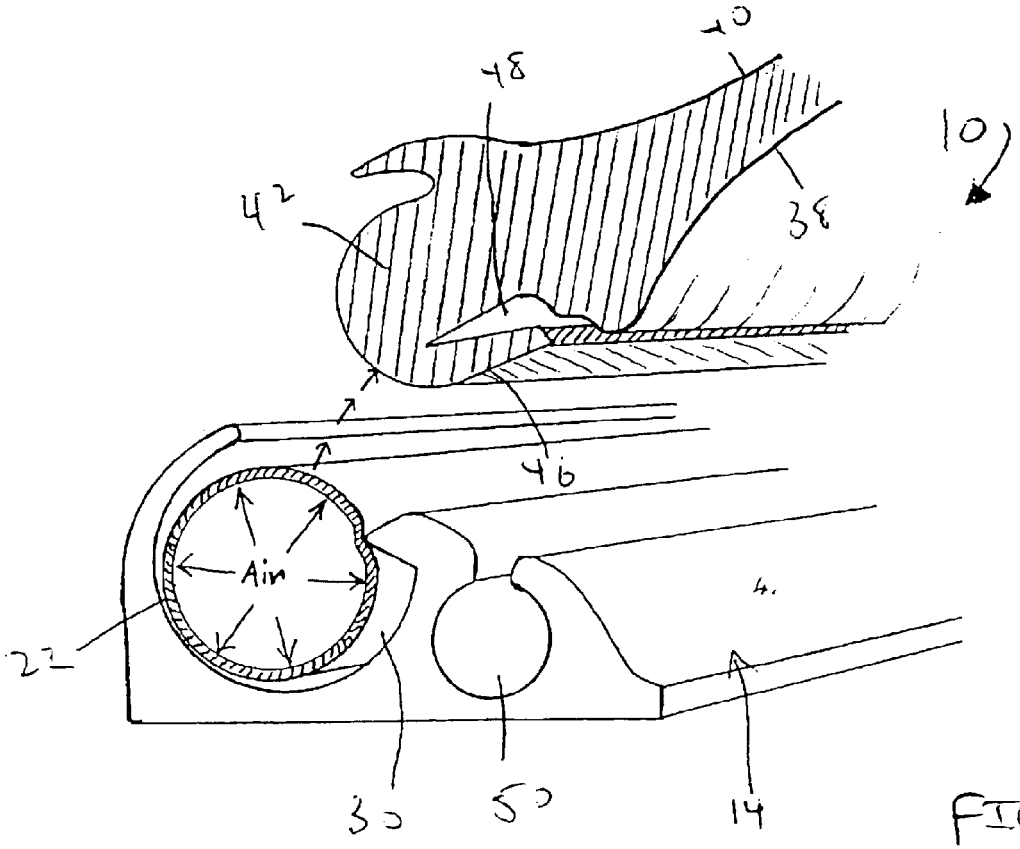
FIG. 11 is a sectional view illustrating the flotation device having the cover-removing tubing inflated to the inflated condition to remove the cover.
Figure 12:
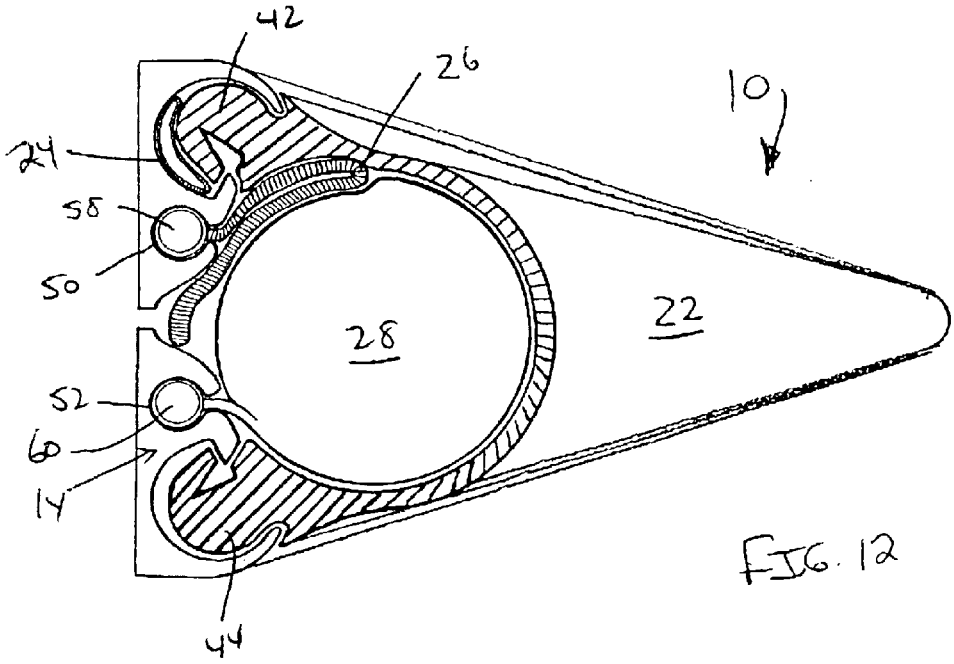
FIG. 12 is a sectional perspective view illustrating the flotation device, constructed in accordance with the present invention, within a mounting plate mounted to a watercraft.
Figure 13:
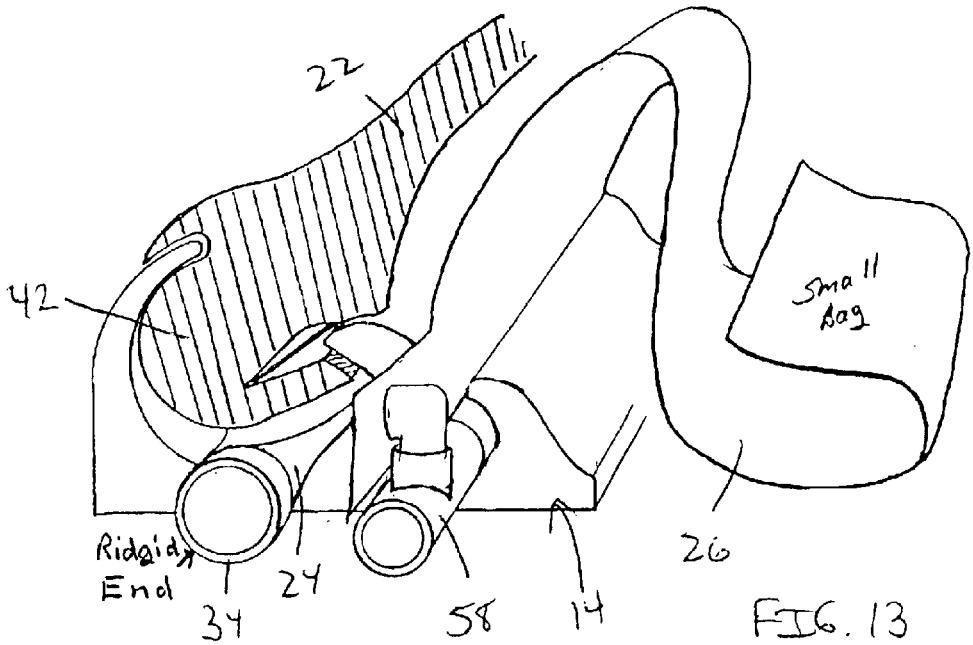
FIG. 13 is a sectional perspective view further illustrating the flotation device, constructed in accordance with the present invention.

Referring back to FIG. 7, the cover 22 has an interior surface 38, an exterior surface 40, a first cover edge 42, and a second cover edge 44 with the first cover edge 42 and the second cover edge 44 extending longitudinally along the length of the cover 22. As illustrated in FIG. 8, the first and second cover edges 42, 44 are shaped to fit in the channels 30, 32, respectively, on the mounting plate 14. Tile cover 22 can be attached to the mounting plate 14 by sliding the first and second cover edges 42, 44 into the channels 30, 32, respectively.

In the alternative, the cover 22 can be snapped into the channels 30, 32 of the mounting plate 14. In this instance, as illustrated in FIGS. 7–13 the first and second cover edges 42, 44 of the cover 22 have a movable finger 46 provided along each side of the cover 22. A space 48 between the fingers 46 and the first and second cover edges 42, 44 of the cover 22 allow the finger 46 to move into the space 48 toward the first and second cover edges 42, 44 and be inserted into the channels 30, 32 and to maintain the first and second cover edges 42, 44 within the channels 30, 32.

The cover 22 of the flotation device 10 of the present invention is preferably constructed from a flexible, durable material, such as thermoplastic rubber, as it is continuously exposed to the elements. As illustrated in FIG. 7, preferably, the cover 22 is initially formed in a substantially flat position thereby allowing the cover 22 to spring back to the substantially flat position upon release from the mounting plate 14. Furthermore, a puncture resistant material 23 can be molded within the cover 22 to inhibit objects from piercing the cover 22 and damaging the flotation bladders 28 thereunder. Actual operation of the cover 22 being removed from the mounting plate 14 will be described in further detail below.

As illustrated in FIGS. 1 and 2, when the mounting plate 14 is mounted on the hull 16 of the watercraft 12 and the cover 22 is in place, the flotation device 10 of the present invention further serves and functions as a bumper to protect the watercraft 12 as it comes in close proximity to a dock or other watercraft.

Figure 37:
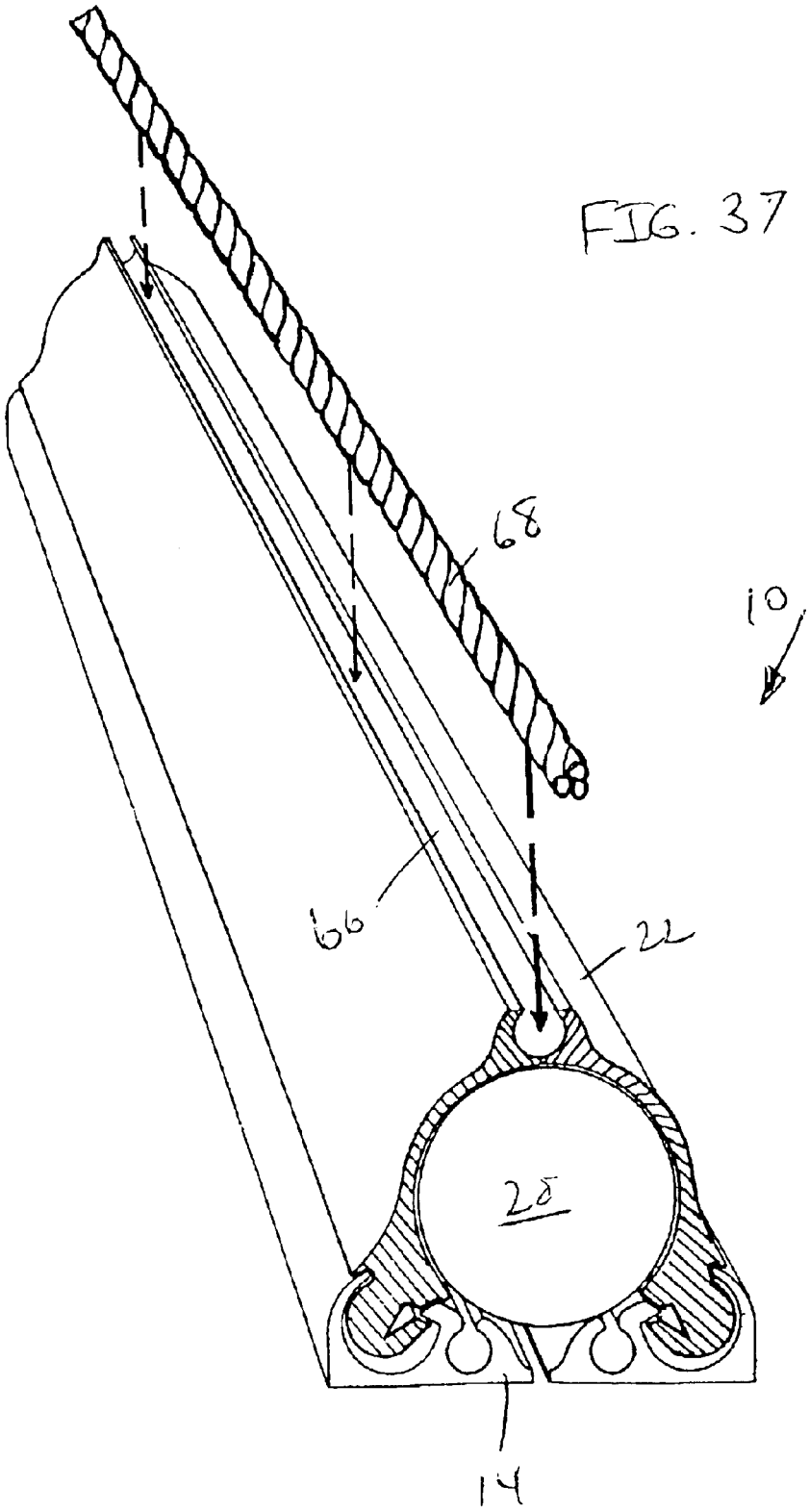
FIG. 37 is an exploded perspective view illustrating the flotation device constructed as a splash rail.
Figure 38:
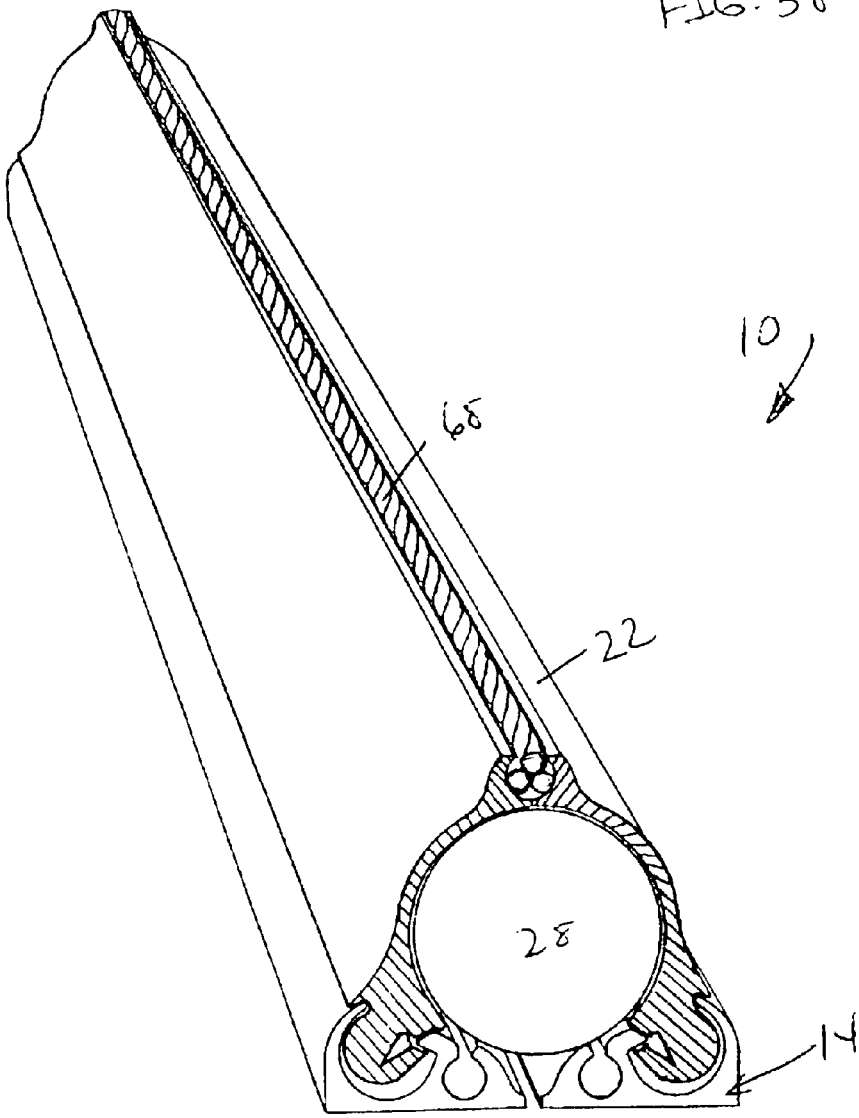
FIG. 38 is a perspective view illustrating the flotation device of FIG. 37.
Figure 39:
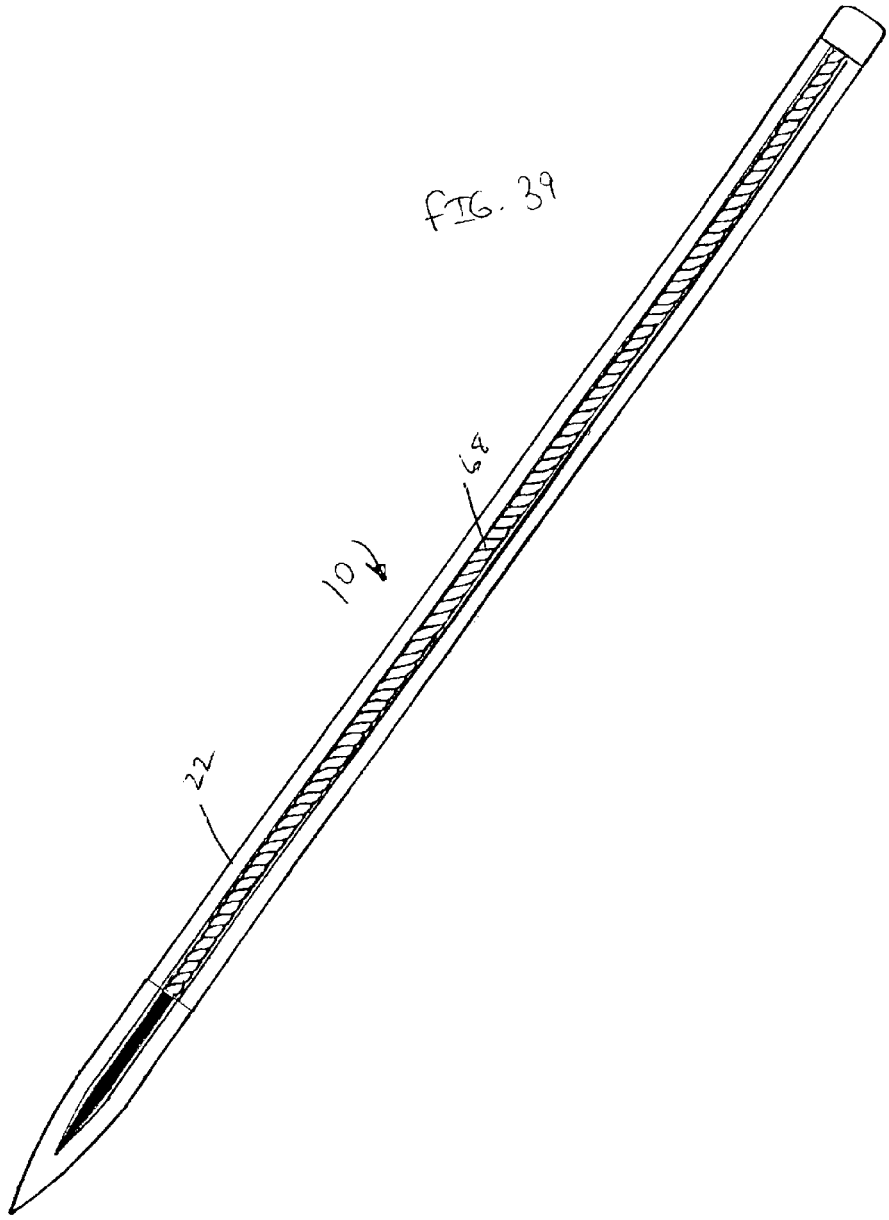
FIG. 39 is another perspective view illustrating the flotation device of FIG. 37.

Furthermore, as illustrated in FIGS. 37–39, the cover 22 of the flotation device 10 can operate and function as a splash rail to inhibit wave splash from entering the watercraft 12, with or without modification to the cover 22. The cover 22 can be formed with a slot 66 in the exterior surface 40 of the cover 22. A rope 68 or the like can be inserted into the slot 66 for an aesthetically visual appearance. It should be noted that any type of modification to the cover 22, or no modification at all, to form the splash rail effect is within the scope of the present invention.

As illustrated in FIG. 14, the flotation device 10 includes a first bladder retaining slot 50 and a second bladder-retaining slot 52 extending along the mounting plate 14 between the first channel 30 and the second channel 32. The first and second bladder retaining slots 50, 52 have narrowed necks at the top of the first and second bladder retaining slots 50, 52. The first and second bladder retaining slots 50, 52 can be any diameter for retaining any size bladders 26, 28 required for maintaining the watercraft 12 in a floating condition.

Figure 15:
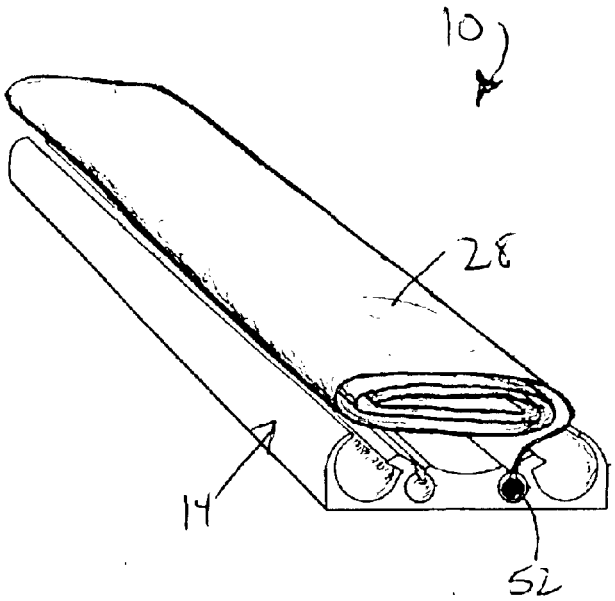
FIG. 15 is a perspective view illustrating the flotation bladder having a flattened spirally wound configuration.
Figure 16:
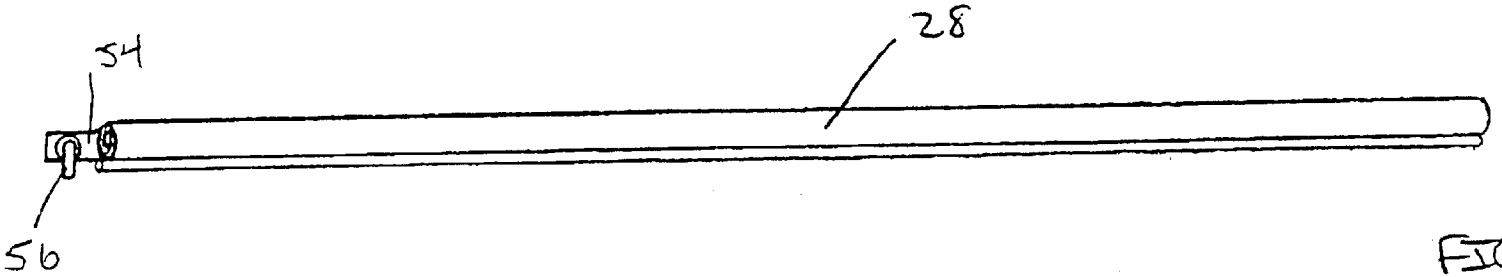
FIG. 16 is an elevational side view illustrating flotation bladder in a rolled and non-inflated condition.
Figure 17:
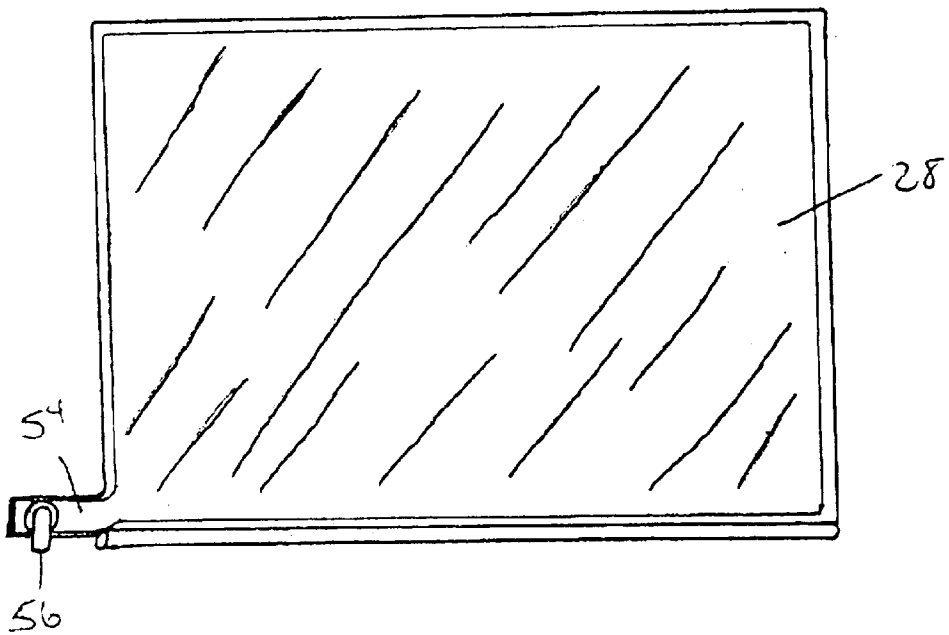
FIG. 17 is an elevational side view illustrating flotation bladder in all unrolled and non-inflated condition.
Figure 18:
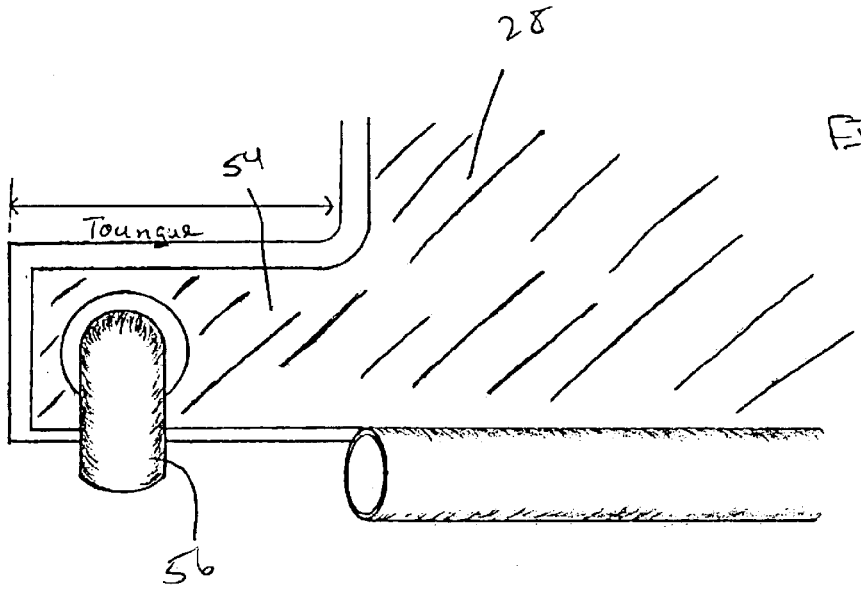
FIG. 18 is an elevational side view illustrating the valve and tongue of the flotation bladder with the flotation bladder being in an unrolled and non-inflated condition.
Figure 19:
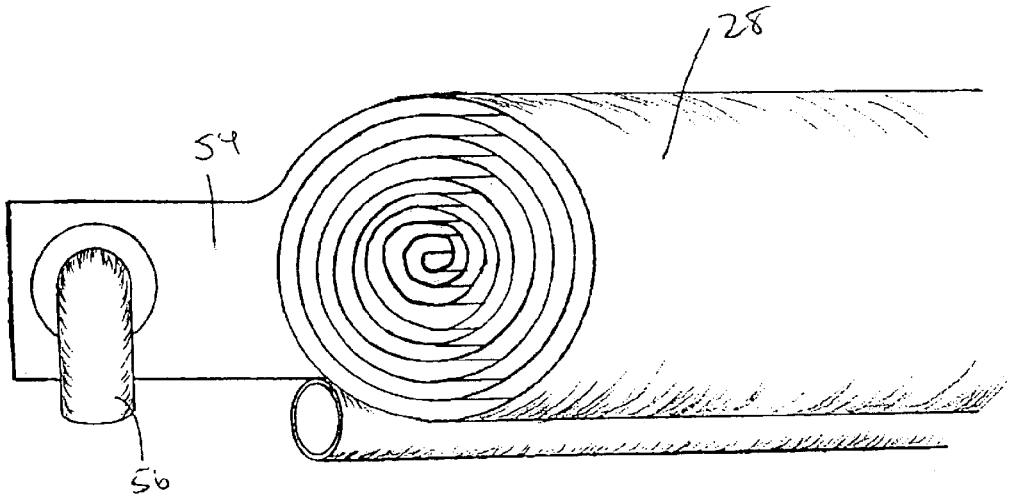
FIG. 19 is an elevational side view illustrating the valve and tongue of the flotation bladder with the flotation bladder in a rolled and non-inflated condition.

As illustrated in FIG. 15, the flotation bladder 28 of the flotation device 10 of the present invention is folded into a substantially spiral configuration to fit between the mounting plate 14 and the cover 22. The flotation bladder 28 can be configured in a round spiral wound or a flat spiral wound. Winding the notation bladder 28 in a flat spiral wound allows the mounted flotation device 10 to have a lower profile on the hull 16 or the watercraft 12.

Referring back to FIG. 12, the directing bladder 26 is folded into a substantially overlaying, serpentine manner to fit between the mounting plate 14 and the flotation bladder 28. Preferably, the directing bladder 26 and the flotation bladder 28 are made from urethane coated ballistic nylon having the edges lap welded to maintain the integrity of the bladders. It should be noted, however, that it is within the scope of the present invention to construct the directing bladder 26 and the flotation bladder 28 from different types of materials and to seal the material with various types of welds, etc.

Now referring to FIGS. 16–19, the flotation bladder 28 has a tongue portion 54. The tongue portion 54 extends from the flotation bladder 28 and connects to the gas supply. The tongue portion 54 allows the flotation bladder 28 to be spirally wound in a tight manner without interference between a valve 56 and the wound flotation bladder 28.

Figure 20:
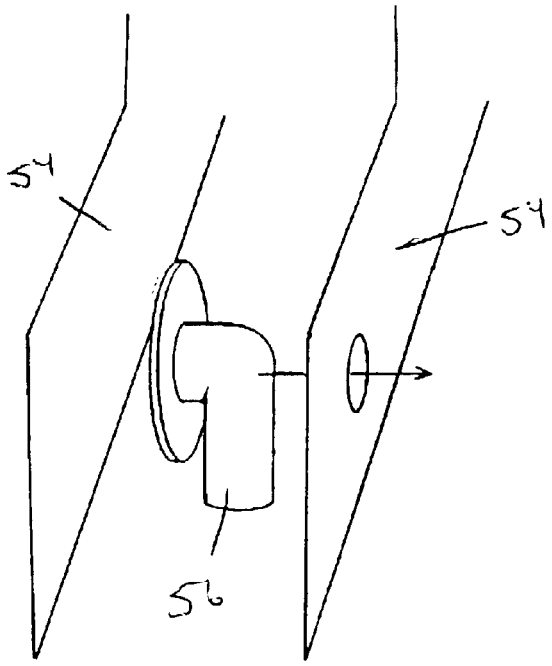
FIG. 20 is an exploded perspective view illustrating the mounting of the valve within the tongue of the flotation bladder.
Figure 21:
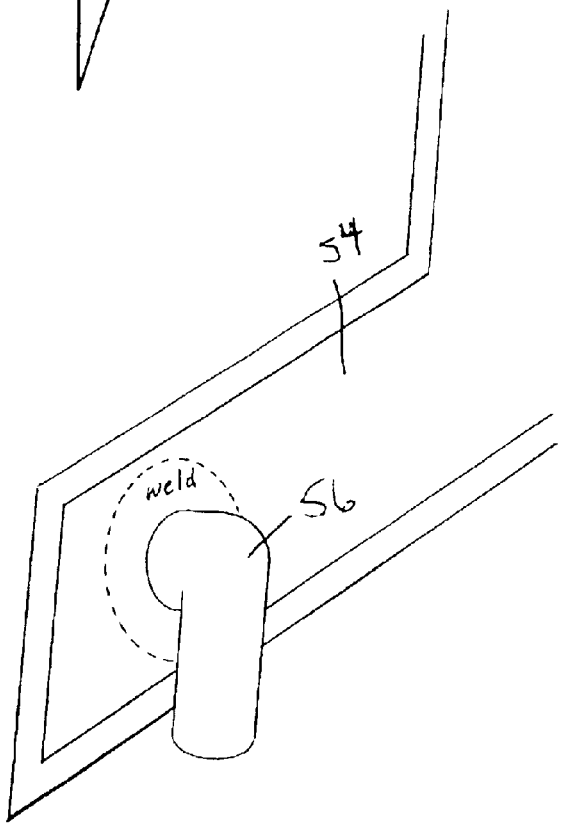
FIG. 21 is a perspective view illustrating the valve mounted within the tongue of the flotation bladder.
Figure 22:
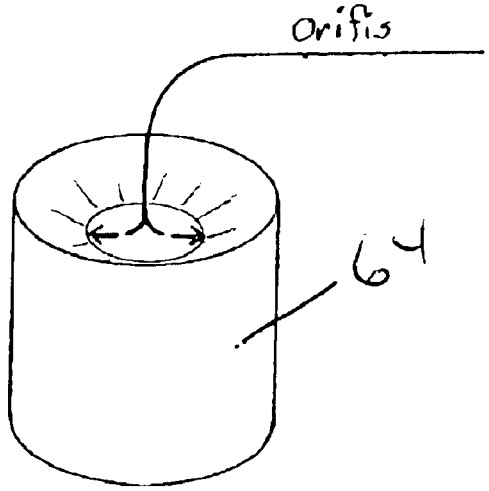
FIG. 22 is a perspective view illustrating an orifice insertable within the valve to control airflow through the valve.
Figure 23:
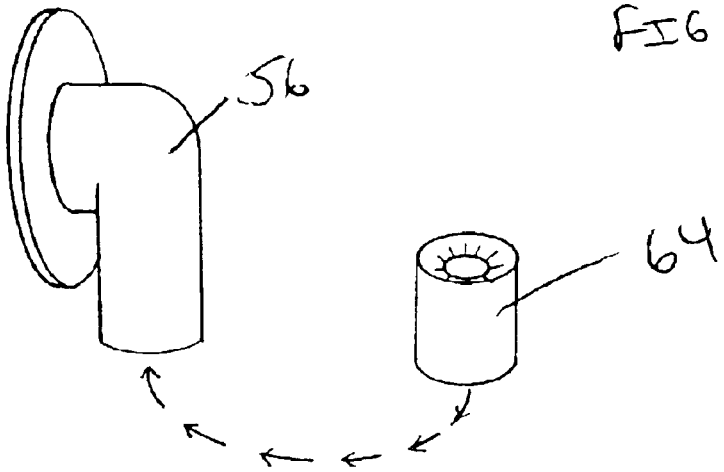
FIG. 23 is a perspective view illustrating the positioning of the orifice within the valve with each valve having various sized orifices to control air flow to the flotation bladders.

As illustrated in FIGS. 20 and 21, the valve 56 is welded within the flotation bladder 28. As illustrated in FIGS. 22–24, each valve 56 has varying sized orifices 64 to control the flow of gas to the flotation bladders 28 and allow inflation of the flotation bladders 28 to be timed subsequent to inflation of the cover-removing tubings 24 and the directing bladders 26.

As illustrated in FIGS. 25–27, the valve 56 of the flotation device 10 of the present invention can be a check valve. As a check valve, only one-way airflow into the flotation bladders 28 is allowed thereby maintaining the flotation bladders 28 in an inflated condition upon cessation of the airflow thereto.

Figure 28:
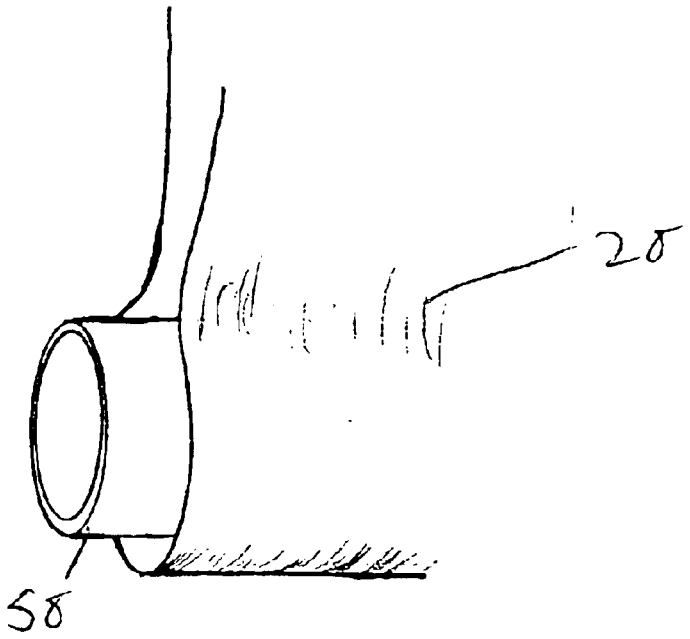
FIGS. 28 and 29 are perspective views illustrating the mounting of the flotation bladders and directing bladders to the gas supply lines.
Figure 29:
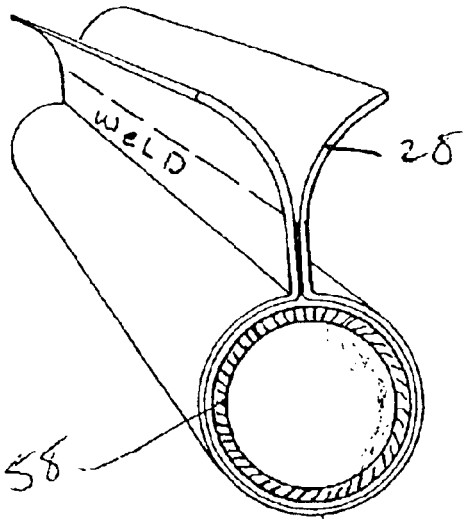

As illustrated in FIGS. 28 and 29, to maintain the directing bladder 26 and the flotation bladder 28 within the first and second bladder retaining slots 50, 52, the directing bladder 26 and the flotation bladder 28 are lap welded about a first gas supply line 58 and a second gas supply line 60, respectively. The first supply line 58 and the second gas supply line 60 are connected to a first gas supply (not shown) and a second gas supply (not shown), respectively, and receivable within the first and second bladder retaining slots 50, 52, to maintain the directing bladder 26 and the flotation bladder 28 to the mounting plate 14. The first and second gas supply lines 58, 60 also serve as a source for filling the cover-removing tubing 24, the directing bladder 26, and the flotation bladder 28 during activation of the flotation device 10.

Figure 32:
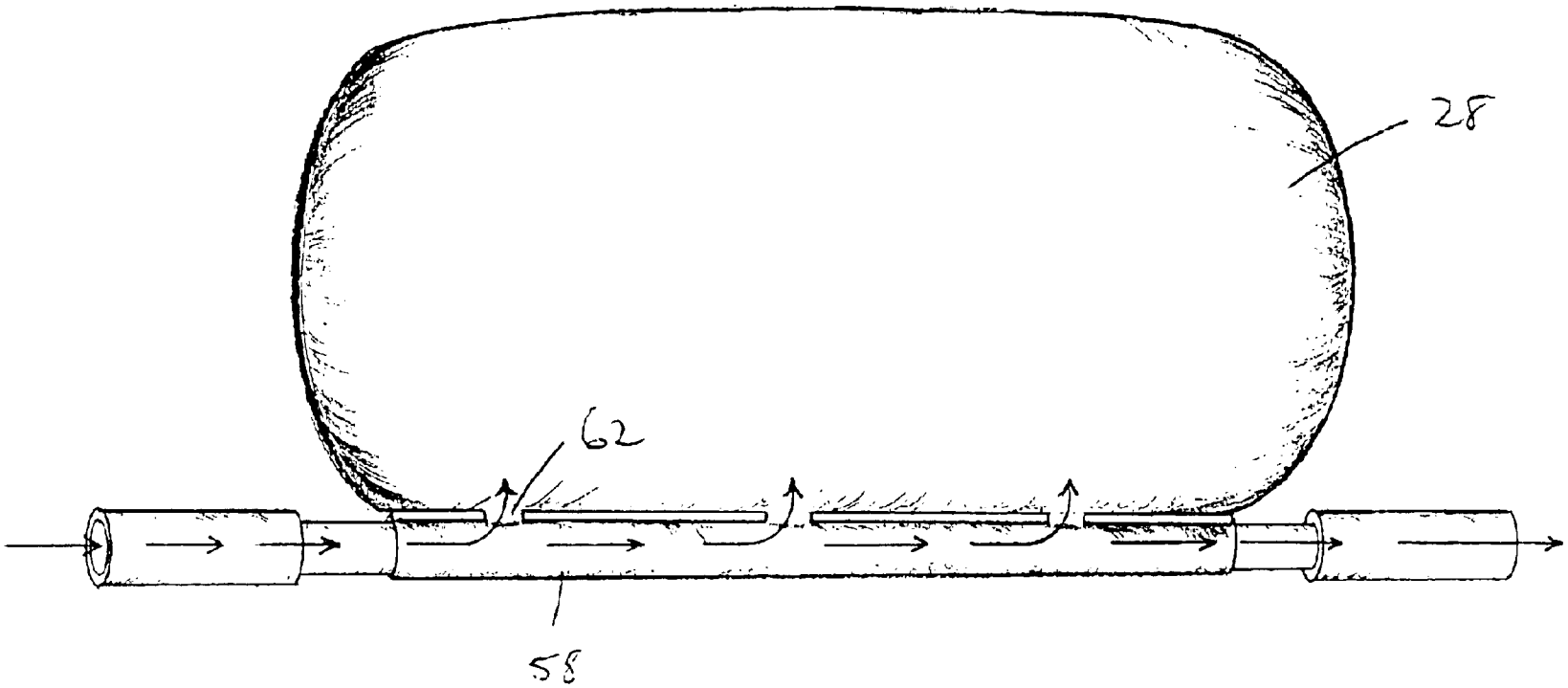

In another embodiment of the flotation device 10 of the present invention, as illustrated in FIGS. 30–32, the gas supply lines 58, 60, have a plurality of apertures 62. The directing bladder 26 and/or the flotation bladder 28 is welded about the gas supply lines 58, 60 such that the gas through the gas supply lines 58, 60 can flow into the directing bladder 26 and/or the flotation bladder 28. Check valves (not shown) can be provided within the gas supply lines 58, 60 or elsewhere to prevent gas from flowing out of the directing bladders 26 and/or the flotation bladders 28 upon cessation of the gas flow.

Figure 33:
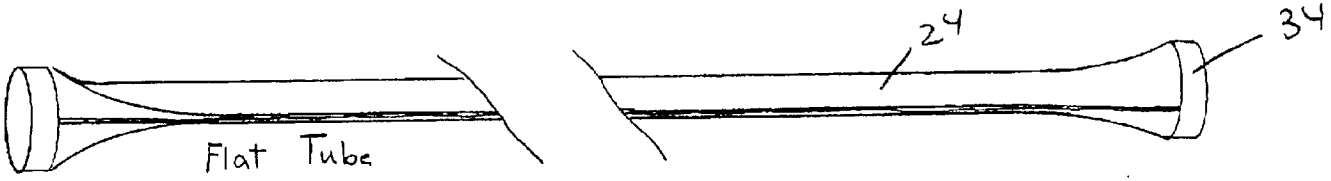
FIG. 33 is an elevational side view illustrating the cover-removing tube in the non-inflated position.
Figure 34:
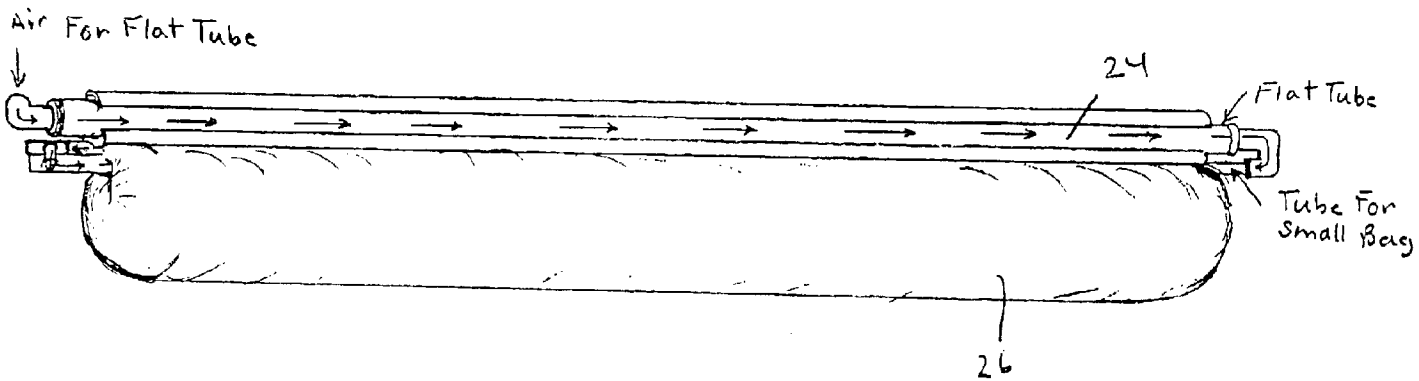
FIG. 34 is a perspective view illustrating the cover-removing tube and the directional bladder in an inflated condition.

As illustrated in FIG. 33, the cover-removing tubing 24 preferably has rigid ends 34 for attaching to a gas supply 36 and connecting the cover-removing tubing 24 together. To remove the cover 22 so that the directing bladder 26 and the flotation bladder 28 can be inflated, inert, compressed gas such as $CO_2$ is released from the first gas supply and flows through the first gas supply line 58 to inflate the cover-removing tubing 24, as illustrated in FIG. 34. As illustrated in FIGS. 8–11, the cover-removing tubing 24 expands and urges the finger 46 into the space 48 in a direction generally toward the first cover edge 42 of the cover 22. As the cover-removing tubing 24 inflates, the moved finger 46 clears the first channel 30. Since the cover-removing tubing 24 and the directing bladder 26 are connected to the same gas supply line, at the same time, the directing bladder 26 is inflating thereby urging the cover 22 in a direction generally away from the mounting plate 14 and removing one side of the cover 22 from the mounting plate 14. The cover 22 remains connected to the mounting plate 14 in the second channel 32 of the cover 22 and swings out of the way of expanding flotation bladder 28.

Figure 35:
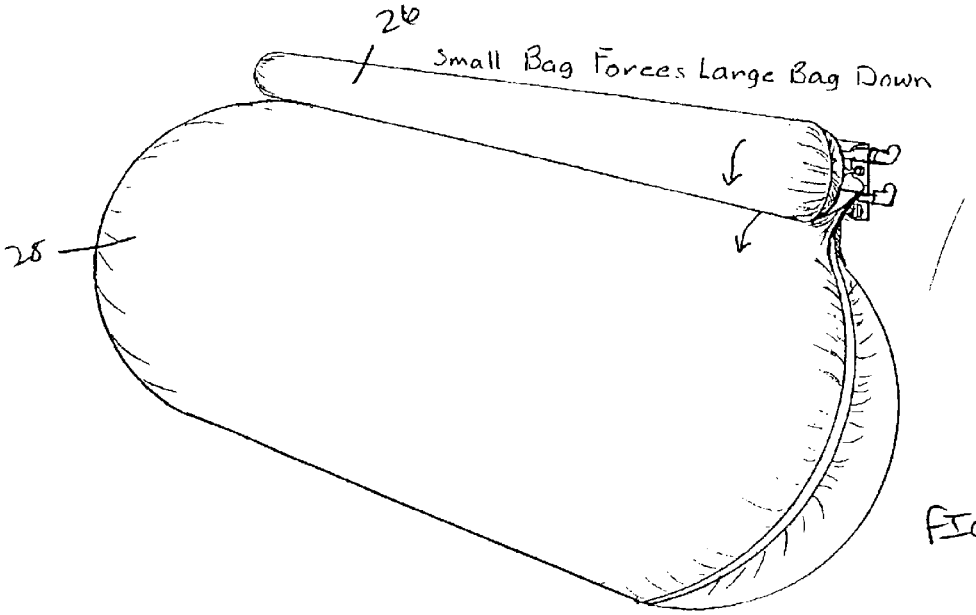
FIG. 35 is a perspective view illustrating the directional bladder and the flotation bladder in an inflated condition.
Figure 36:
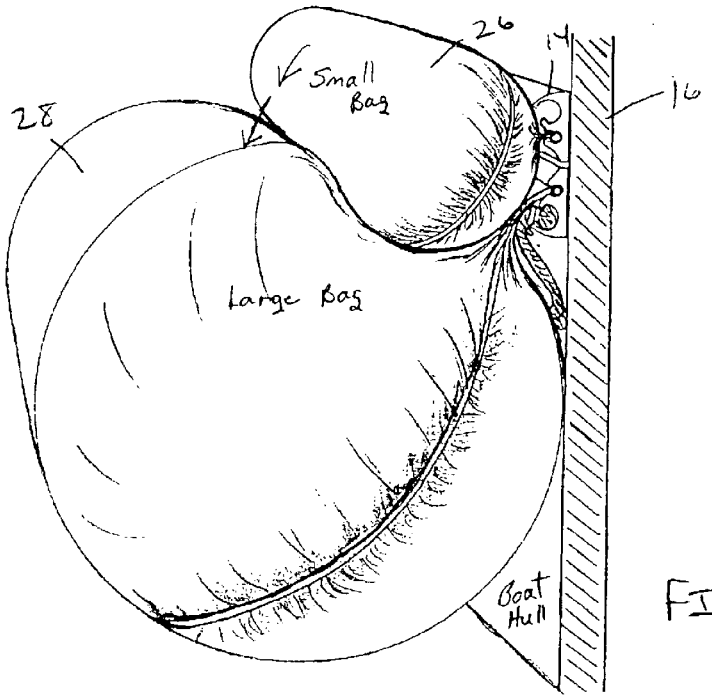
FIG. 36 is a another perspective view illustrating the directional bladder and the flotation bladder in an inflated condition with the directing bladder urging the flotation bladder into the water.

As illustrated in FIGS. 35 and 36, the flotation bladders 28 are inflated from the second gas supply. The preferred embodiment of the cover-removing tubing 24, the directing bladder 26, and the flotation bladders 28 are single bladders that are each a given length and are attached to mounting plate 14 individually. It should be noted that the directing bladders 24 and the flotation bladders 28 can be constructed from more than a single bladder with each portion inflating individually. As will be noted, the directing bladders 26 force the flotation bladders 26 deeper into the water thereby raising the watercraft 12 from the water and limiting the extent of sinking of the watercraft 12.

Either type of the cover-removing tubing 24, the directing bladder 26, and the flotation bladder 28 can be used with any of the embodiments of the flotation device 10. The plurality of directing bladders 26 and the flotation bladders 28 are the preferred embodiment because they are easier to manufacture and makes the flotation device 10 easier to mount on a variety of watercrafts 12. The cover-removing tubings 24, the directing bladders 26, and the flotation bladders 28 are manufactured in a given length and the needed numbers of tubings and bladders 24, 26, 28 are positioned along the length of the hull 16 of the watercraft 12.

A float switch activation assembly activates the flotation device 10 of the present invention. The float switch activation assembly is described in pending patent application Ser. No. 09/832,774, filed Apr. 10, 2001, entitled "Automatic Boat Flotation Device" and pending patent application Ser. No. 09/864,642, filed May 24, 2001, entitled "Float Switch Activation Assembly", assigned to the same assignee of the present invention and which are hereby herein incorporated by reference.

The float switch activation assembly is mounted on the inside of the hull 16 of the watercraft 12 and is fluidly connected to the first gas supply. Extending from the float switch activation assembly is the first gas supply line 58 connected to the cover-removing tubings 24 and the directing bladders 26. Upon activation of the float switch activation assembly, gas flows from the first gas supply through the first gas supply line 58 to the cover-removing tubings 24 and the directing bladders 26 thereby inflating the cover-removing tubings 24 and the directing bladders 26 and removing the cover 22.

As the gas flows to the cover-removing tubing 24 and the directing bladders 26, the gas also flows from the second gas supply through the second gas supply line 60 to the flotation bladders 28. It should be noted that redundant gas supplies are within the scope of the present invention for supplying gas to the flotation device 10 in case of a mid-ship collision or compromise of the integrity of the flotation device 10.

Figure 40:
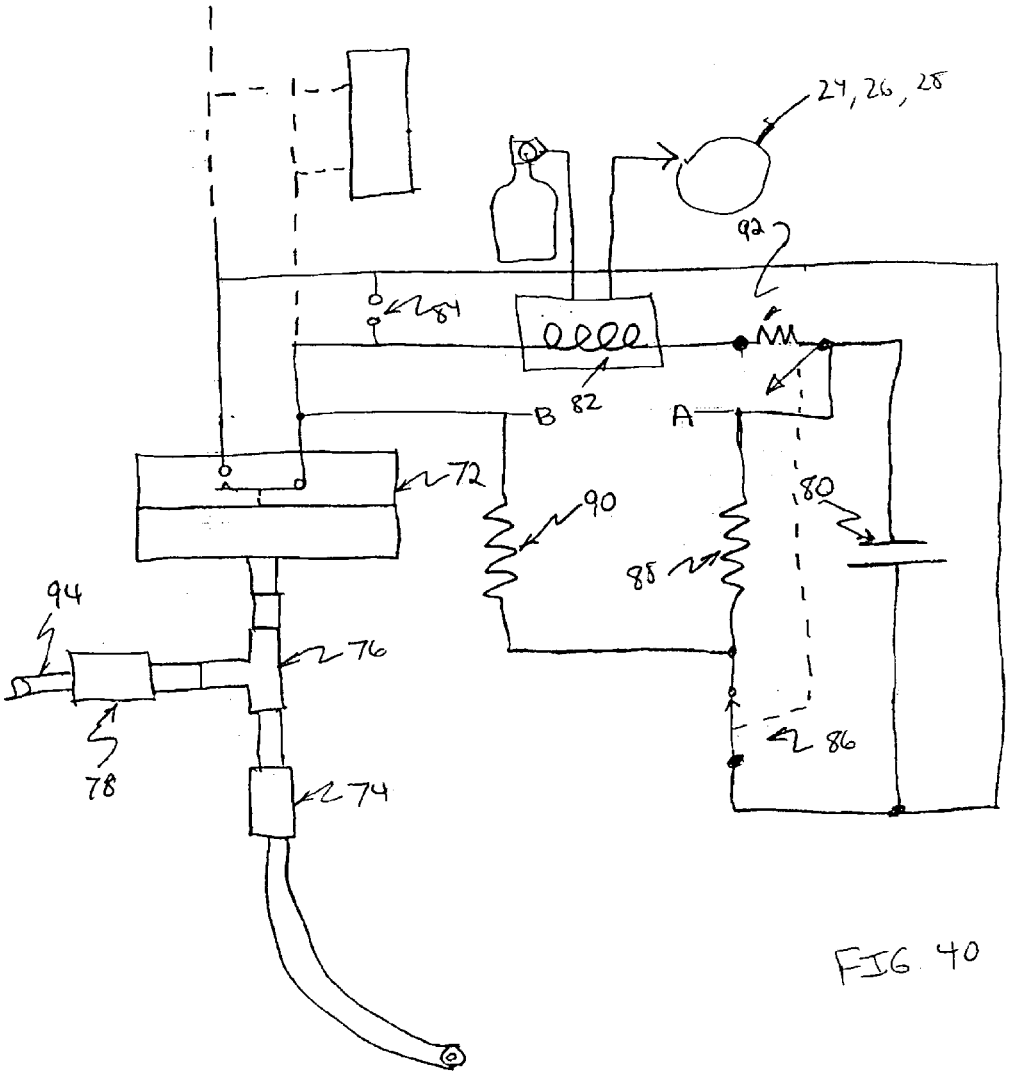
FIG. 40 is schematic view illustrating an electrical bladder deployment system with self test.
Figure 41:
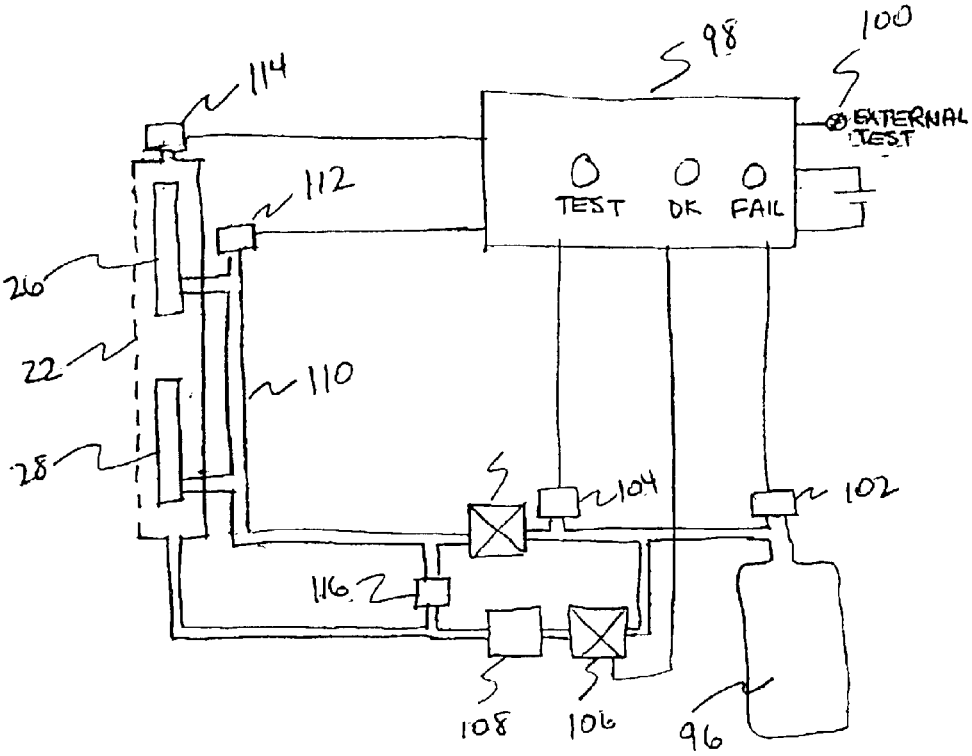
FIG. 41 is another schematic view illustrating the electrical bladder deployment system of the present invention.

As illustrated in FIGS. 40 and 41, the activation of the flotation device 10 of the present invention can be accomplished by an electrical bladder deployment system 70 with self test. The electrical bladder deployment system 70 is deployed when the water level within the hull 16 reaches a predetermined level. The electrical bladder deployment system 70 preferably uses multiple sensors in case the vessel experienced pitch or yaw while flooded and can perform a confidence test on demand to assure that the system 70 is operational. In addition, the system 70 is a test system which does not compromise the integrity of the system 70 by inserting additional test elements into the system which could increase the probability of system failures. A system 70 using electronic sensors and a simple control system meets these requirements. The electrical bladder deployment system 70 of the present invention is easily installed in existing vessels without extensive mechanical modifications.

A trigger side diagnostic method example will now be described. A normally open diaphragm switch 72, or the like, sensitive to water level in the range of approximately six (6 in.) inches to approximately twelve (12 in.) inches of water is attached to the interior of the hull 16. Multiple switches can be mounted, for example, fore and aft, and side to side of the hull 16. Each diaphragm switch 72 or sensor includes a flow restrictor 74 to provide damping to reduce the occurrence of false triggering. Each switch also includes a test T 76 and ball check 78 connected to a test system to be described later.

From each diaphragm switch 72, a hose is connected to a location in hull 16 where it is desired to monitor water level. When the water rises to a predetermined level, the diaphragm switch is triggered sending current from the preferred lithium-ion battery source 80 through a latching electrically operated valve 82, such as a motor driven type, allowing compressed gas to inflate the flotation bladders 24, 26, 28 preventing, the watercraft 12 from sinking. An auxiliary contact 84 can be closed by some external system such as a fire mitigation system or manual intervention to deploy the bladders 24, 26, 28 without use of the float switches.

The electrical bladder deployment system 70 of the present invention also allows operational checking to prove out the valve connection, battery strength, and switch operation to obtain confidence testing of the system. The switch 86 is the test switch. In one state, the system 70 is in normal operation. In the other state, as shown, the test function is activated. A resistor 88 presents a load to the battery equivalent to the load of the latching valve 82 to assure adequate power is available to operate the valve 82. Voltage is monitored at test point A by a voltmeter or analog to digital converter. Resistors 90 and 92 allow a small test current to flow through the latching valve 82 which does not resulting, deployment, voltage point B is used to measure the resistance and wiring drop to the valve 82 by a voltmeter or analog to digital converter connected to a test system.

To test the diaphragm switch 86, a small pressure is placed on the test line 94 connected to the ball check valve 78 to close the switch 86 while monitoring the voltage at test point B which will be reduce in value during the time the pressure is above the test value 82. Flow restrictor 74 bleeds off the test pressure allowing normal operation. With multiple diaphragm switches each can be pressurized in sequence or multiple sense resistors 92 can be used to determine switch closure during test. A test system can present the result of the test with an indicator showing for example red for system unsafe or green for system test passed. Alternatively voltmeter readiness may be interpreted to determine system readiness. A microprocessor may be used to sequence and automate the tests.

A pressure-side diagnostic method example will now be described. Electronic or mechanical pressure switches are monitored to confidence-test the bag-side system integrity. Pressure tank 96 contains compressed gas, $CO_2$ for example, for inflating the floatation bladders 26, 28. Pressure sensors can be simple pressure switches or electronic pressure sensors. The sensor outputs are connected to a test controller and power supply 98 which may contain a microprocessor. Tests can be started by the user or run automatically through terminal 100, for example when starting the engines and the test results may be displayed with more or less detail for the user. The sensor 102 monitors the inflation pressure tank to assure a minimum pressure exists in the system. The sensor 104 is located at the pressure release valve to assure that line pressure is available. Flow limiting valve 106 and regulator 108 are actuated to apply a small pressure to the bladder deployment manifold 110 this can be the same low pressure source as used in the float switch test above. Pressure at the far side of the manifold is monitored by sensor 112. If the system is free of leaks sensor 112 can also be used as a leak-down test to determine if any small leaks exist in the system 70 by waiting a predetermined time and determining if the pressure is still above a minimum acceptable level. Using another sensor 114 and the low pressure source, a similar test can be run on the cover 22 (rub rail) to assure it has not been breached. Check valve 116 assures that high pressure is not fed to the cover 22 during deployment alternatively a small orifice may be used to limit gas flow.

The above methods may be combined or used separately. Test results can be reported back to other vessel safety systems.

The flotation device 10 of the present invention, when activated, increases the beam of the watercraft 12 thereby increasing the stability of the watercraft 12 to inhibit the watercraft 12 from tipping over during rough water conditions. The flotation device 10 of the present invention can also provide an emergency notification signal or other type of signal based on the water level in the hull 16 of the watercraft 12. Furthermore, the flotation device 10 can be used as a splash rail.

The foregoing exemplary descriptions and the illustrative preferred embodiments of the present invention have been explained in the drawings and described in detail, with varying modifications and alternative embodiments being, taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A flotation device for floating a watercraft, the flotation device comprising:

a cover releasably secured to the watercraft;

at least one directing bladder positioned between the cover and the watercraft; and at least one inflatable flotation bladder positioned between the cover and the watercraft;

wherein upon inflation of the directing bladder, the directing bladder releases at least a portion of the cover from the watercraft.

2. The flotation device of claim 1, and further comprising:

a carrier mounted to the watercraft, the carrier having a first cover channel, a second cover channel, a first bladder-retaining slot, and a second bladder-retaining slot;

wherein the cover has a first cover edge and a second cover edge, the first cover edge receivable in the first cover channel and the second cover edge receivable in the second cover channel.

3. The flotation device of claim 2, and further comprising:

inflation means connected to the directional bladder and the flotation bladder for inflating the directional bladder and the flotation bladder;

wherein upon inflation of the directional bladder, the first edge of the cover is released from the first cover channel of the carrier and is moved in a direction generally away from the watercraft allowing the directional bladder and the flotation bladder to substantially inflate.

4. The flotation device of claim 1, and further comprising:

a first finger formed on the first edge of the cover; and a first space between the first finger and the first edge, the first finger deformable into the first space to release the first edge of the cover from the first cover channel.

5. The flotation device of claim 1, and further comprising:

a second finger formed on the second edge of the cover; and a second space between the second finger and the second edge, the second finger deformable into the second space to release the second edge of the cover from the second cover channel.

6. The flotation device of claim 2, and further comprising:

a first gas supply tubing receivable within the first bladder retaining slot and connected to the inflation means, the directing bladder being secured to the first gas supply tubing such that gas flowing through the first gas supply tubing inflates the directing bladder; and a second gas supply tubing receivable within the second bladder retaining slot and connected to the inflation means, the flotation bladder being secured to the second gas supply tubing such that gas flowing through the second gas supply tubing inflates the flotation bladder.

7. The flotation device of claim 6 wherein the directional bladder is inflated prior to inflation of the flotation bladder.

8. The flotation device of claim 1 and further comprising:

a float switch activating a valve upon a predetermined amount of water entering the watercraft, the valve connected to the inflation means for activating the inflation means.

9. The flotation device of claim 1 wherein the inflation means includes a first gas supply and a second gas supply, the first gas supply being connected to the directional bladder and the second gas supply being connected to the flotation bladder wherein upon activation of the float switch, the gas from the first gas supply activates the gas flow from the second gas supply.

10. The flotation device of claim 1 wherein the directional bladder is in an overlapping configuration prior to inflation.

11. The flotation device of claim 1 wherein the flotation bladder is in a substantially flattened spiral configuration prior to inflation.

12. The flotation device of claim 1 wherein the flotation bladder comprises a plurality of flotation bladders along the waterline of the watercraft, each flotation bladder being independently inflatable.

13. A method for maintaining a watercraft in a floating condition, the method comprising:

releasably securing a cover to the watercraft;

positioning at least one directing bladder between the cover and the watercraft;

positioning at least one inflatable flotation bladder between the cover and the watercraft;

inflating the directing bladder; and inflating the flotation bladder.

14. The method of claim 13, and further comprising:

mounting a carrier to the watercraft, the carrier having a first cover channel, a second cover channel, a first bladder-retaining slot, and a second bladder-retaining slot;

wherein the cover has a first cover edge and a second cover edge, the first cover edge receivable in the first cover channel and the second cover edge receivable in the second cover channel.

15. The method of claim 13, and further comprising:

forming a first finger on the first edge of the cover;

defining a first space between the first finger and the first edge; and deforming the first finger into the first space to release the first edge of the cover from the first cover channel.

16. The method of claim 13, and further comprising:

forming a second finger on the second edge of the cover;

defining a second space between the second finger and the second edge; and deforming the second finger into the second space to release the second edge of the cover from the second cover channel.

17. The method of claim 13, and further comprising:

activating a float switch upon a predetermined amount of water entering the watercraft, the float switch connected to inflation means for inflating the directing bladder and the flotation bladder.

18. The method of claim 13, and further comprising:

positioning the directional bladder in an overlapping configuration prior to inflation.

19. The method of claim 13, and further comprising:

positioning the flotation bladder in a substantially flattened spiral configuration prior to inflation.

* * * * *